US008080734B2

(12) United States Patent
Mukai et al.

(10) Patent No.: US 8,080,734 B2
(45) Date of Patent: Dec. 20, 2011

(54) SHIELDED CABLE

(75) Inventors: Koichi Mukai, Ishikawa (JP); Yoshitaka Yoshino, Tokyo (JP); Chisato Komori, Ishikawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/720,344

(22) Filed: Mar. 9, 2010

(65) Prior Publication Data

US 2010/0236810 A1 Sep. 23, 2010

(30) Foreign Application Priority Data

Mar. 19, 2009 (JP) ..... 2009-069089

(51) Int. Cl.
*H01R 4/00* (2006.01)

(52) U.S. Cl. ..... 174/102 R; 174/105 R; 174/84 R; 174/88 C

(58) Field of Classification Search ..... 174/36, 174/102 R, 105 R, 107, 108, 109, 106 R, 174/84 R, 88 R, 88 C
See application file for complete search history.

(56) References Cited

U.S. PATENT DOCUMENTS

| | | | | |
|---|---|---|---|---|
| 4,376,920 | A * | 3/1983 | Smith | 333/12 |
| 4,642,417 | A * | 2/1987 | Ruthrof et al. | 174/36 |
| 5,150,442 | A * | 9/1992 | Desmons | 385/101 |
| 6,800,810 | B1 * | 10/2004 | Page | 174/102 R |
| 6,815,617 | B1 * | 11/2004 | Gebs et al. | 174/113 AS |
| 2006/0011376 | A1 * | 1/2006 | Van Den Berg et al. | 174/120 R |

FOREIGN PATENT DOCUMENTS

| | | | |
|---|---|---|---|
| JP | 10-334750 | A * | 12/1998 |
| JP | 2006-164830 | A * | 6/2006 |

* cited by examiner

*Primary Examiner* — William Mayo, III
(74) *Attorney, Agent, or Firm* — Wolf, Greenfield & Sacks, P.C.

(57) ABSTRACT

A shielded cable includes an inner conductor, a first insulator, a first outer conductor, a second insulator, and a second outer conductor, which are coaxially disposed in this order from an inner side, and has an outer circumference coated by an insulation sheath.

8 Claims, 47 Drawing Sheets

| ITEM | MATERIAL | CONFIGURATION [STRIKE/PIECE/mm] | OUTER DIAMETER [mm] |
|---|---|---|---|
| INNER CONDUCTOR | UEW | 2 UEW 0.08×2×3 | 0.25 |
| FIRST INSULATOR | HD−PE | THICKNESS 0.14 | 0.61 |
| BRAIDED SHIELD (FIRST OUTER CONDUCTOR) | NAKED ANNEALED COPPER WIRE | 16/2/0.06 | 0.89 |
| SECOND INSULATOR | HD−PE | THICKNESS 0.58 | 2 |
| BRAIDED SHIELD (SECOND OUTER CONDUCTOR) | NAKED ANNEALED COPPER WIRE | 16/2/0.06 | 2.27 |
| JACKET (INSULATION SHEATH) | NHFR | THICKNESS 0.17 | 2.6 |

FIG. 8A
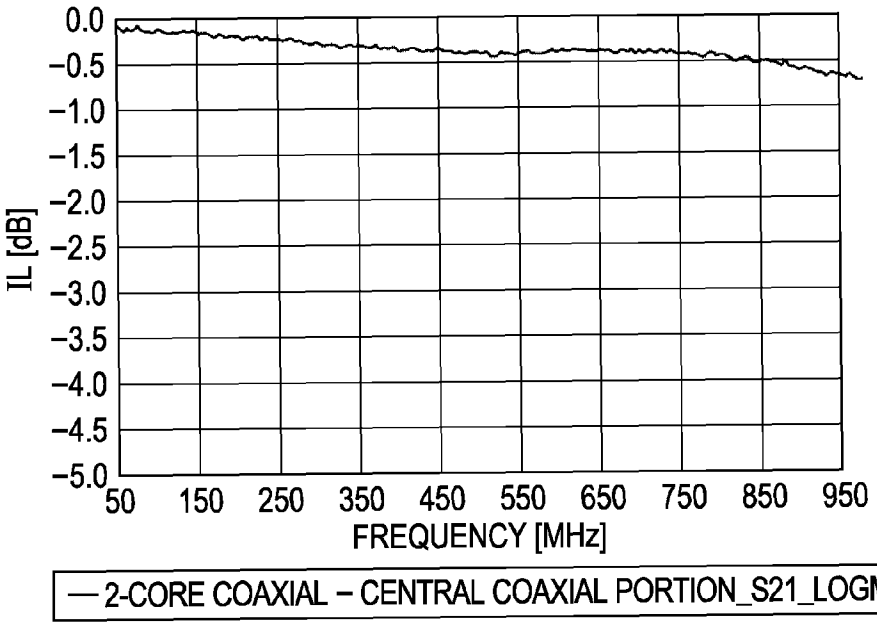
FIG. 8B
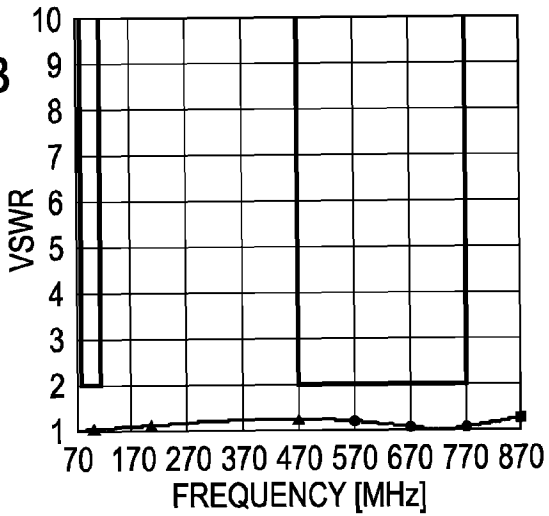
FIG. 8C
| FREQUENCY [MHz] | S11 (R+jX) | S21 IL [dB] |
|---|---|---|
| 100 | 49.18−j3.15 | −0.1 |
| 200 | 44.21−j2.78 | −0.2 |
| 470 | 45.37+j10.83 | −0.4 |
| 570 | 51.89+j9.49 | −0.4 |
| 670 | 52.29+j3.70 | −0.4 |
| 770 | 46.10+j0.77 | −0.4 |
| 870 | 39.56+j5.65 | −0.5 |
FIG. 8D
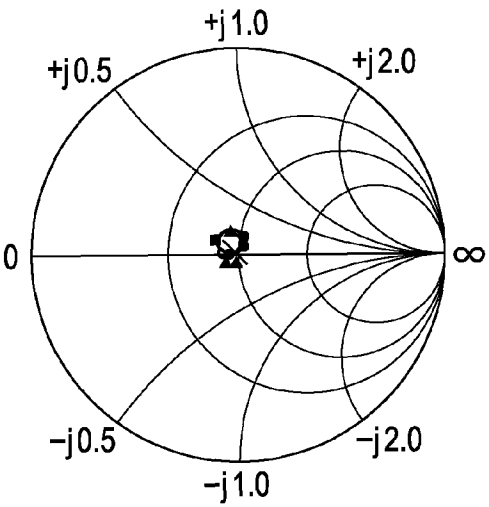

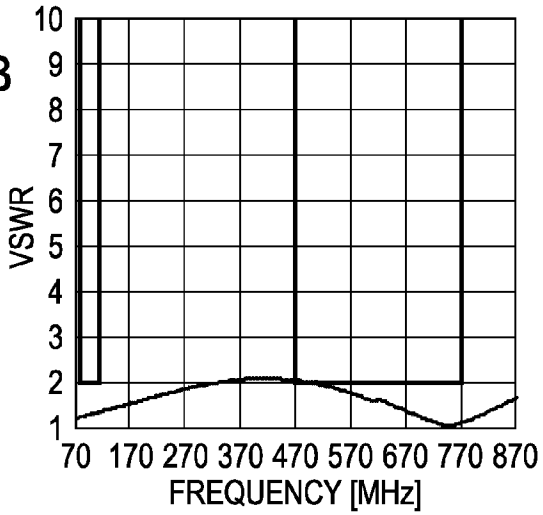
FIG. 9B
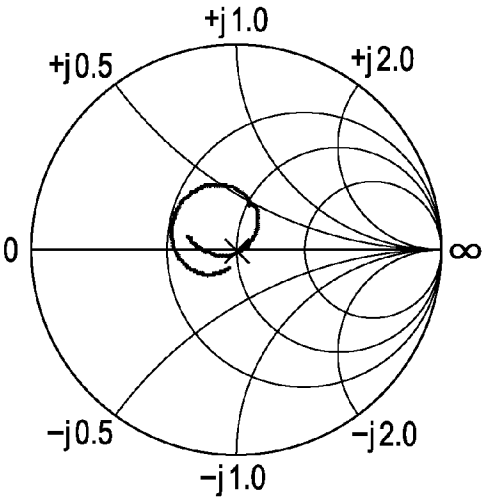
FIG. 9D
FIG. 9A
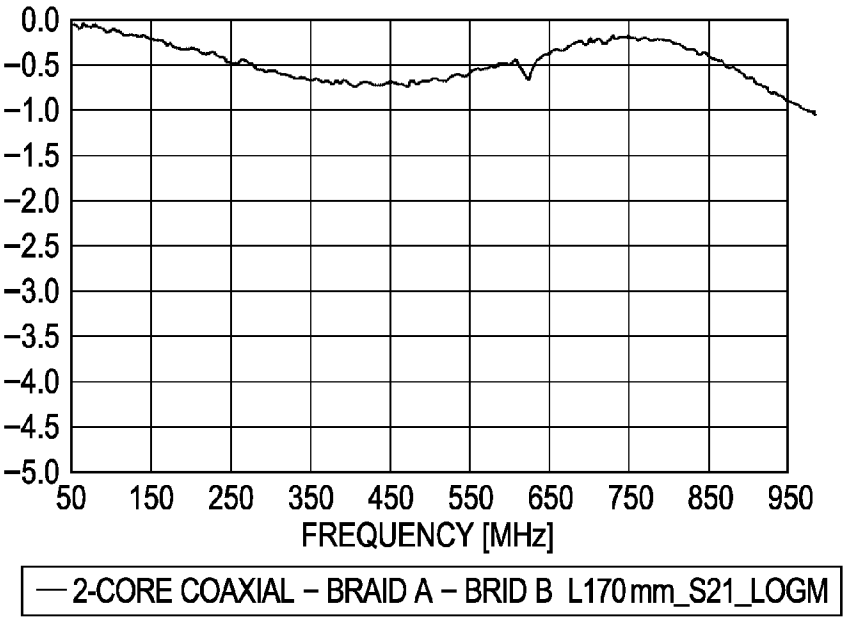
FIG. 9C
| FREQUENCY [MHz] | S11 (R+jX) | S21 IL [dB] |
|---|---|---|
| 100 | 42.92 − j9.32 | −0.1 |
| 200 | 31.87 − j6.68 | −0.3 |
| 470 | 31.08 + j21.26 | −0.7 |
| 570 | 45.25 + j26.62 | −0.5 |
| 670 | 59.72 + j13.90 | −0.3 |
| 770 | 46.76 − j2.52 | −0.2 |
| 870 | 30.78 + j4.13 | −0.5 |

30A

30A

30A

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −14.13 | −14.20 | −14.44 | −16.28 | −13.96 | −12.40 | −18.25 | −15.33 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −3.40 | −0.69 | −0.24 | −3.28 | −4.92 | −2.35 | −3.25 | −5.38 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −11.60 | −10.00 | −10.13 | −12.28 | −10.92 | −9.15 | −12.65 | −12.63 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −6.00 | −2.29 | −1.93 | −5.68 | −5.52 | −3.18 | −6.85 | −6.83 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −13.33 | −12.49 | −14.64 | −11.61 | −8.72 | −9.20 | −14.25 | −13.78 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −1.33 | −1.80 | −1.84 | −4.28 | −5.32 | −2.98 | −4.65 | −4.23 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −11.20 | −9.69 | −10.24 | −11.68 | −8.87 | −8.55 | −13.85 | −10.63 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −6.00 | −3.49 | −3.04 | −6.08 | −8.56 | −3.15 | −5.65 | −8.03 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −15.20 | −10.78 | −13.21 | −20.14 | −14.96 | −13.38 | −17.25 | −3.03 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −9.60 | −2.66 | −4.41 | −9.81 | −6.92 | −4.33 | −5.05 | 1.97 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −18.67 | −13.38 | −14.86 | −16.88 | −15.72 | −19.11 | −20.65 | −3.97 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −9.07 | −1.98 | −3.33 | −4.34 | −4.92 | −4.35 | −7.05 | 1.08 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −16.80 | −14.09 | −15.41 | −22.28 | −15.42 | −10.91 | −11.85 | −10.68 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −7.80 | −4.46 | −5.81 | −11.21 | −7.32 | −3.15 | −3.65 | −4.63 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −13.80 | −13.38 | −15.84 | −21.21 | −14.76 | −10.60 | −12.45 | −6.58 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −12.00 | −7.18 | −7.41 | −10.21 | −6.12 | −2.15 | −5.25 | −6.23 |

IF A COAXIAL CABLE IS SHORT-CIRCUITED AT A LENGTH OF 1/4λ, IMPEDANCE VIEWED FROM PORT 1 BECOMES INFINITY.

BY USING THIS CHARACTERISTIC, AN UNNECESSARY ELECTRIC CURRENT WHICH IS CARRIED BY THE CABLE IS CUT AT A SLEEVE PORTION.

IF A COAXIAL CABLE IS OPENED AT A LENGTH OF 1/2λ, IMPEDANCE VIEWED FROM PORT 1 BECOMES INFINITY.

BY USING THIS CHARACTERISTIC, AN UNNECESSARY ELECTRIC CURRENT WHICH IS CARRIED BY THE CABLE IS CUT AT A SLEEVE PORTION.

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −17.20 | −12.29 | −10.53 | −11.28 | −16.32 | −14.15 | −21.05 | −10.08 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −10.87 | −4.09 | 0.96 | −0.88 | −3.36 | −4.18 | −10.05 | −2.78 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −18.73 | −12.58 | −9.86 | −12.08 | −12.32 | −9.78 | −17.05 | −9.98 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −10.47 | −2.38 | −0.73 | −3.28 | −5.56 | −4.58 | −8.85 | −3.83 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −15.60 | −11.09 | −9.24 | −15.47 | −9.32 | −8.78 | −14.05 | −12.38 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −5.80 | −1.49 | −0.64 | −4.54 | −4.12 | −2.75 | −6.25 | −4.73 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −13.00 | −9.98 | −10.64 | −11.87 | −10.12 | −9.55 | −14.45 | −10.58 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −8.80 | −3.49 | −1.64 | −5.81 | −4.67 | −3.58 | −7.05 | −5.38 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −17.87 | −18.20 | −13.35 | −14.94 | −15.12 | −14.35 | −19.25 | −11.23 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.20 | −3.89 | 1.05 | −0.88 | −2.12 | −2.58 | −7.05 | −1.13 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −16.33 | −16.49 | −12.35 | −16.28 | −16.07 | −12.35 | −17.25 | −11.38 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −5.53 | −3.20 | 0.16 | −3.54 | −5.32 | −4.75 | −8.45 | −1.03 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −15.33 | −14.00 | −11.64 | −11.68 | −9.56 | −9.35 | −14.45 | −12.48 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.73 | −1.80 | −0.35 | −2.54 | −3.92 | −3.35 | −6.85 | −1.38 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −15.60 | −12.00 | −9.35 | −10.88 | −8.52 | −7.55 | −12.65 | −5.78 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.86 | −3.89 | −0.95 | −2.94 | −4.72 | −3.95 | −7.05 | −0.78 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −13.20 | −11.80 | −15.33 | −19.53 | −19.58 | −17.35 | −18.25 | −17.48 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −1.00 | −0.60 | −2.84 | −7.21 | −7.52 | −5.95 | −8.25 | −2.83 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −19.80 | −17.20 | −16.84 | −15.14 | −11.47 | −4.53 | −8.25 | −12.18 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −1.07 | 1.11 | −0.93 | −3.61 | −1.96 | −2.55 | −4.05 | −4.23 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −22.47 | −21.49 | −18.26 | −17.28 | −19.16 | −17.58 | −24.45 | −16.03 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −0.73 | 1.11 | 0.36 | −2.34 | −2.87 | −2.98 | −7.05 | −3.32 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −12.00 | −8.29 | −11.84 | −16.47 | −19.32 | −16.75 | −20.45 | −12.32 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −5.80 | −0.09 | −1.95 | −4.81 | −5.27 | −4.13 | −8.05 | −5.68 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −19.13 | −17.60 | −17.55 | −17.88 | −13.32 | −9.55 | −14.65 | −12.13 |

| | HORIZONTAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −8.40 | −5.49 | −3.15 | −5.01 | −2.67 | 2.05 | −1.05 | −2.38 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −17.80 | −12.78 | −12.84 | −15.34 | −9.12 | −5.15 | −9.45 | −13.48 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −6.60 | −2.89 | −3.44 | −8.88 | −6.52 | −0.35 | −2.45 | −3.23 |

SHIELDED CABLE

BACKGROUND OF THE INVENTION

1. Field of the Invention

The present invention relates to a shielded cable having flexibility which is applicable to portable electronic devices such as portable AV equipment and mobile telephones.

2. Description of the Related Art

In the field of consumer electronic products, there is AV equipment typified by portable sound reproduction equipment, and so on, and there is also a case where the sound of the equipment itself is heard through earphones (including headphones) using a coaxial cable.

In recent years, a portable television receiver has been also developed, and there is also a case where the sound thereof is heard through earphones the earphones. A cable for earphones is formed by a shielded cable and also used in the transmission of a high-frequency signal of a receiving antenna or the like.

In this manner, the technology of using an earphones cable as an antenna has been proposed.

This kind of cable is used in order to transmit an audio signal (low frequency band), and, for example, in a case where it is used for an application to antennas of VHF and UHF, there is a case where it is not suitable due to a large loss in a high-frequency signal.

Also, in the case of an ordinary coaxial cable called 3C-2V or 5C-2V for a high-frequency signal, although by optimizing high-frequency design, a high-frequency transmission characteristic could become excellent, there was a problem in that it is thick, heavy, and low in flexibility or tensile properties and durability performance at a movable portion is very poor.

Therefore, the applicant proposed a shielded cable which can be used in a movable portion like an earphone cable and transmit a direct-current signal (refers to Japanese Unexamined Patent Application Publication No. 2006-164830).

Since as a principal conductor of the shielded cable, an ordinary annealed copper wire can be used, and also, as a reinforcing filament body, a general-purpose filament body can be used, the cable can be manufactured at a low price.

Also, by using a filament body of a material, which is low in rigidity, but high in tensile strength properties, for a reinforcing filament body of the shielded cable, it becomes possible to prevent occurrence of the breaking of wire by increasing tensile strength without lowering a bending property and flexibility, and also, secure a given electric characteristic.

Also, as an example of an antenna using a coaxial cable, a so-called sleeve antenna is proposed (for example, refers to FIG. 1 of Japanese Unexamined Patent Application Publication No. 2003-249817 and FIG. 1 of Japanese Unexamined Patent Application Publication No. 2003-8333).

In the case of the sleeve antenna, the antenna has a structure in which a signal is transmitted by a coaxial cable and an antenna element is disposed at the leading end of the coaxial cable.

Particularly noteworthy is a folded structure of a ground GND, which is called a sleeve.

The sleeve antenna blocks an electric current, which is carried by an outer covering of the cable, by increasing impedance in terms of high-frequency by the folded structure of the sleeve.

SUMMARY OF THE INVENTION

However, in the antenna disclosed in Japanese Unexamined Patent Application Publication No. 2006-164830, since in the case of a sleeve antenna, there is no folded structure, in a case where the antenna is adopted to, for example, a mobile telephone and so on, it is necessary to perform resonance by making a set ground GND and a ground GND of the coaxial cable to function as GND of the antenna.

Therefore, in this antenna, there is a fear that the fact that resonance frequency varies by the length of the connected set ground GND will become a problem.

Also, since the set ground GND also contributes to the radiation of the antenna, in a case such as mobile communication which is used with held by a human body, since the set ground GND is grasped, there is a fear that the gain of the antenna will be affected.

Also, in the above-described sleeve antenna, the coaxial cable is used only for a signal transmission function and an antenna portion has a very complicated structure.

In particular, in the sleeve antenna disclosed in Japanese Unexamined Patent Application Publication No. 2003-249817 (FIG. 1), the sleeve portion includes sheet metal, so that flexibility and design property are poor, and there are disadvantages of a larger size, complication, and a higher price.

The present invention provides a shielded cable which can realize a shielded antenna cable which is low in cost and is excellent in design property and flexibility.

According to an embodiment of the present invention, there is provided a shielded cable including an inner conductor, a first insulator, a first outer conductor, a second insulator, and a second outer conductor, which are coaxially disposed in this order from an inner side, and having an outer circumference coated by an insulation sheath. For example, the inner conductor includes a plurality of element wires, and a filament body formed using a material having higher tensile strength properties than that of the element wire in a portion out of the plurality of element wires, and the first outer conductor and the second outer conductor are formed by braided shields which are braided by a plurality of electrically-conductive element wires.

According to the embodiment of the present invention, a shielded antenna cable which is low in cost and is excellent in design properties and flexibility can be realized.

BRIEF DESCRIPTION OF THE DRAWINGS

FIGS. 8A to 8D are diagrams showing a passage loss of the inner conductor and a first outer conductor;

FIGS. 9A to 9D are diagrams showing a passage loss of the first outer conductor and a second outer conductor;

DESCRIPTION OF THE PREFERRED EMBODIMENTS

Hereinafter, embodiments of the present invention will be explained in connection with the drawings.

Also, explanation will be made in the following order.

1. A first embodiment (a first structure example of a shielded cable),
2. A second embodiment (a second structure example of a shielded cable),
3. A third embodiment (a first configuration example of an antenna device),
4. A fourth embodiment (a second configuration example of an antenna device), and
5. A fifth embodiment (a third configuration example of an antenna device).

1. First Embodiment

FIGS. 1A, 1B, 2A, and 2B are diagrams showing a structure example of a shielded cable according to the first embodiment of the present invention.

Figure 1A:
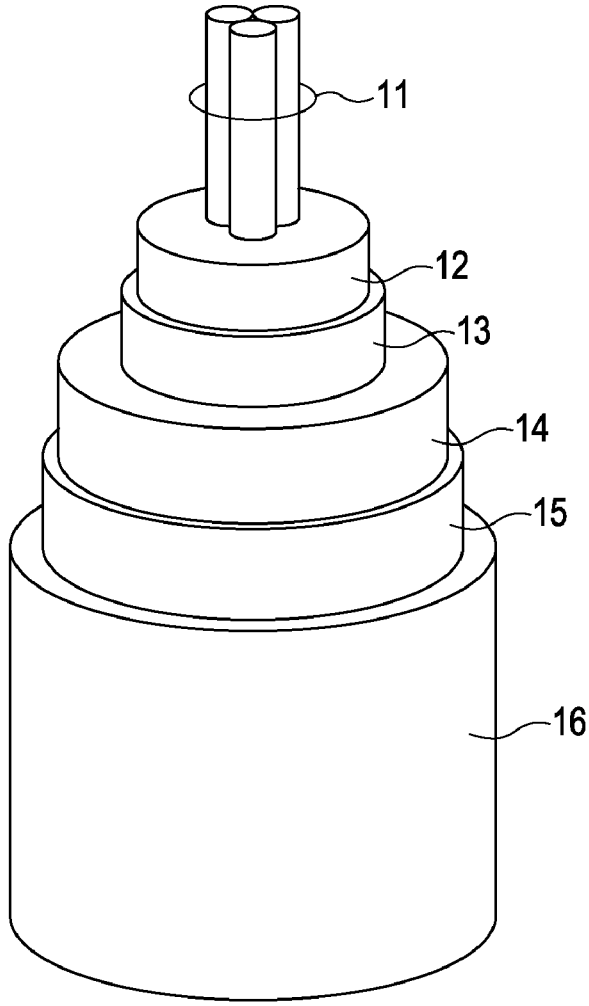
FIGS. 1A and 1B are first diagrams showing a structure example of a shielded cable according to a first embodiment of the present invention.
Figure 1B:
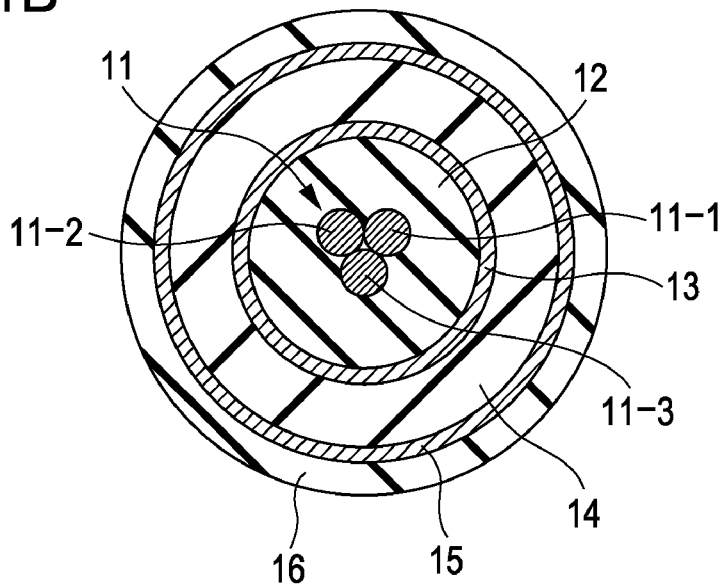

FIG. 1A is a perspective view showing each constituent member of the shielded cable according to the first embodiment in an exposed state. FIG. 1B is a simple cross-sectional view of the shielded cable according to the first embodiment.

Figure 2B:
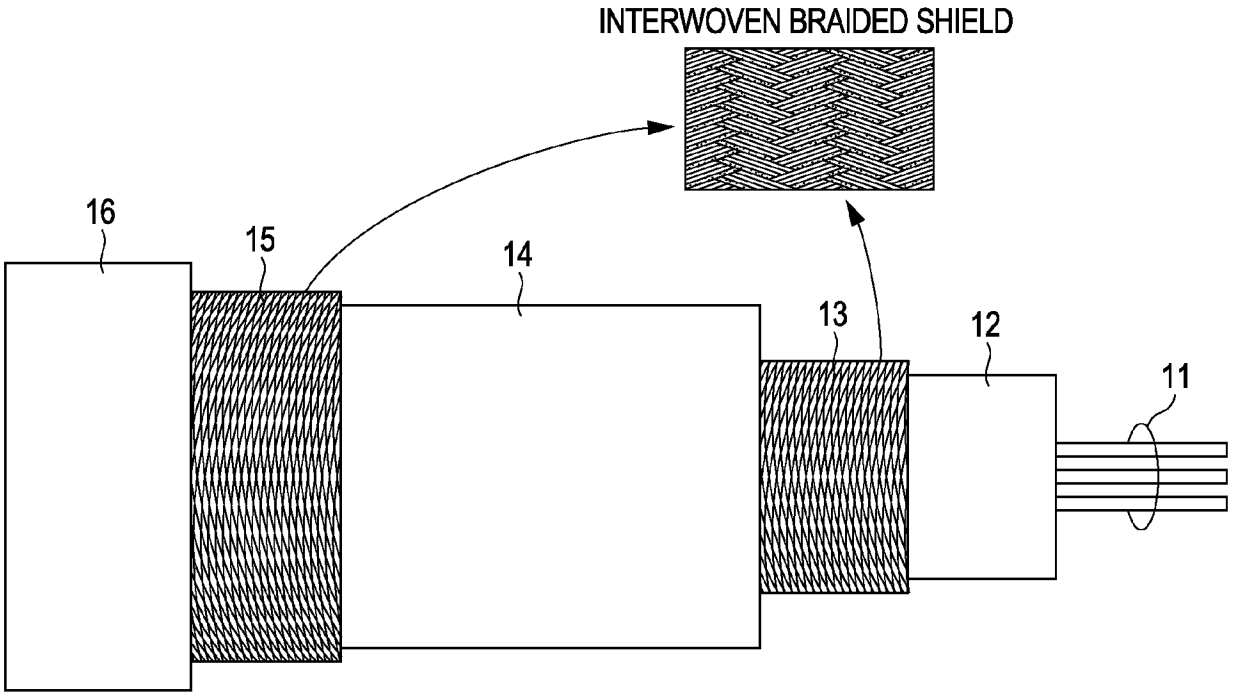
FIGS. 2A and 2B are second diagrams showing a structure example of the shielded cable according to the first embodiment of the present invention.
Figure 2A:
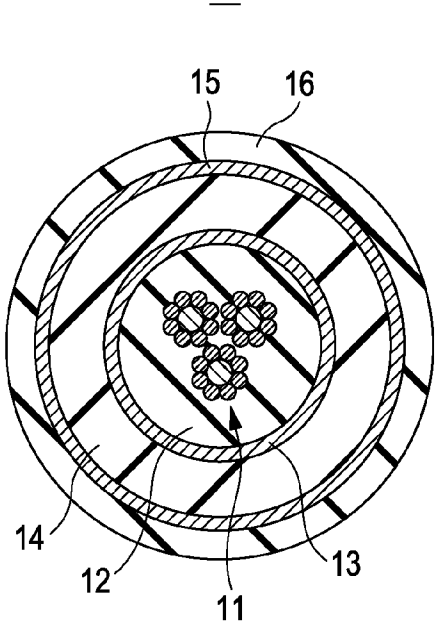

FIG. 2A is a simple cross-sectional view of the shielded cable according to the first embodiment, and FIG. 2B is a side view showing each constituent member of the shielded cable according to the first embodiment in an exposed state.

A shielded cable 10 of this embodiment is formed as a coaxial and double shielded cable. In other words, the shielded cable 10 of this embodiment has a double coaxial cable structure.

[Configuration of Double Shielded Cable]

The shielded cable 10 includes an inner conductor (there is also a case where it is called a central conductor) 11, a first insulator 12, a first outer conductor 13, a second insulator 14, and a second outer conductor 15, which are coaxially disposed in this order from an inner side, and is covered at its outer circumference by an insulation sheath 16.

That is, in the shielded cable 10, the inner conductor 11 is insulated by the first insulator 12, and the first outer conductor 13 is coaxially disposed on the outer circumference of the first insulator 12. Also, in the shielded cable 10, the first outer conductor 13 is insulated by the second insulator 14, and the second outer conductor 15 is coaxially disposed on the outer circumference of the second insulator 14.

Then, the entire outer circumference of the shielded cable 10 is coated by the insulation sheath 16.

The inner conductor 11, the first outer conductor 13, the first outer conductor 13, and the second outer conductor 15 have impedance in terms of high-frequency.

The inner conductor 11 is constituted by one or a plurality of wires.

In the example shown in FIGS. 1A, 1B, 2A, and 2B, the inner conductor 11 is constituted by three wires 11-1, 11-2, and 11-3.

Figure 3:
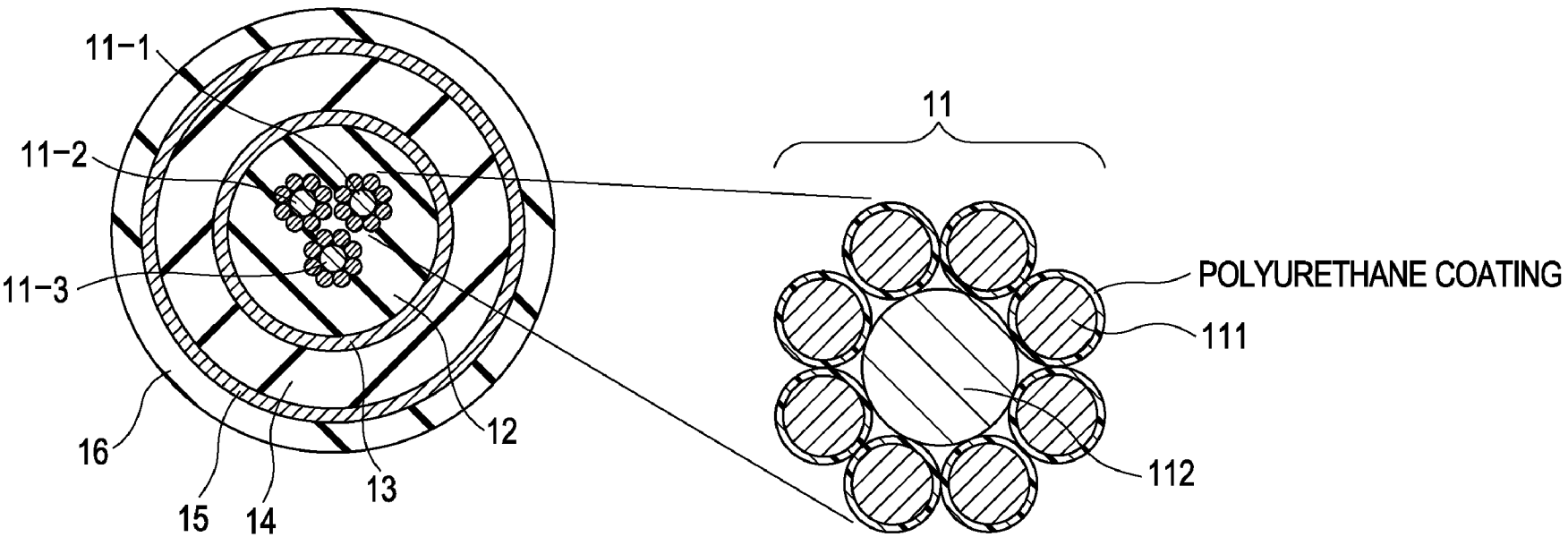
FIG. 3 is a first diagram illustrating a configuration example of an inner conductor according to the embodiment.
Figure 4:
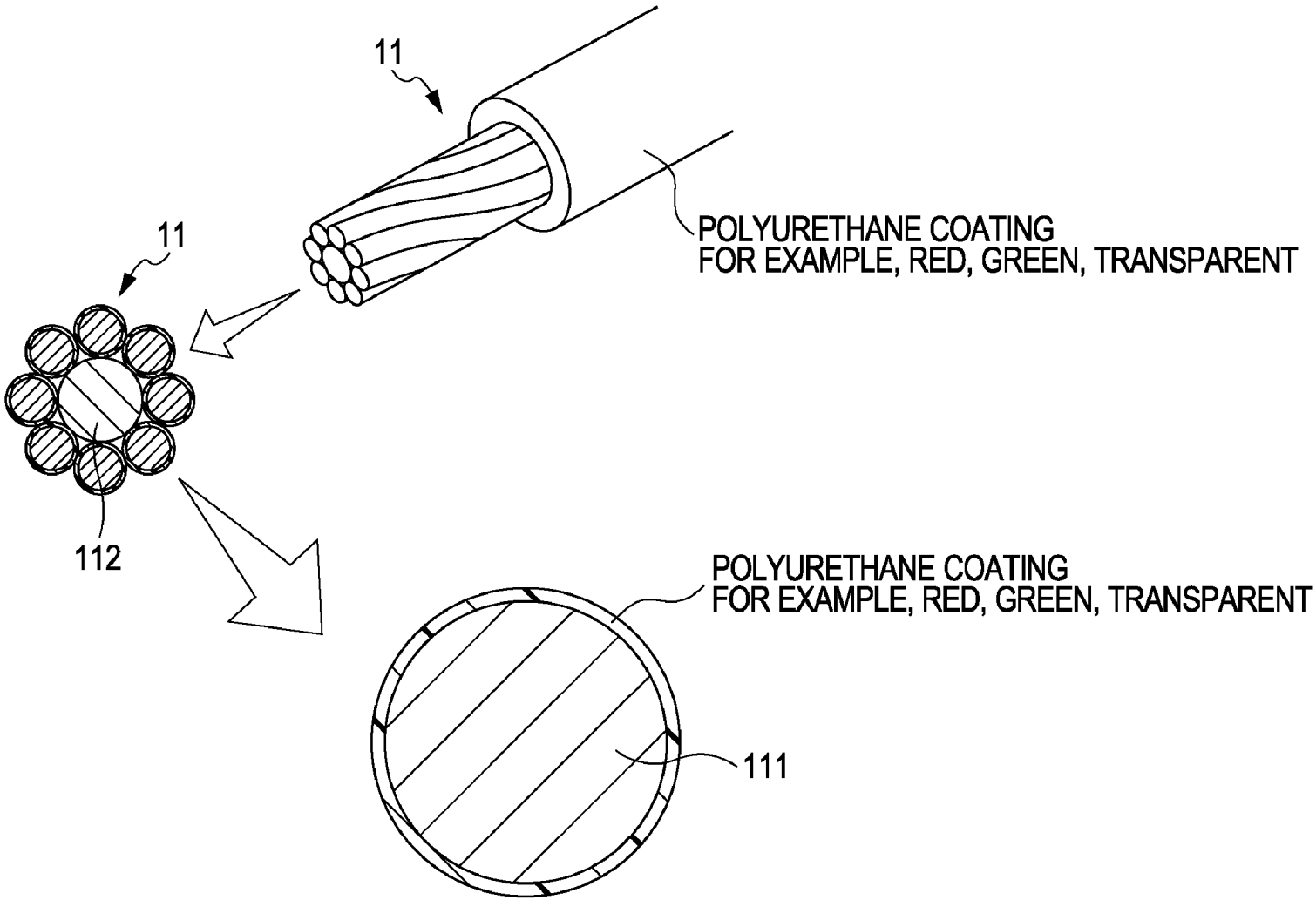
FIG. 4 is a second diagram illustrating a configuration example of the inner conductor according to the embodiment.

FIGS. 3 and 4 are diagrams illustrating a configuration example of the inner conductor according to this embodiment.

As shown in FIGS. 3 and 4, each wire of the inner conductor 11 includes a plurality of element wires 111, and a filament body 112 formed using a material having higher tensile strength properties than that of the element wire in a portion out of the plurality of element wires 111.

In the inner conductor 11, a wire made of, for example, a coated polyurethane wire is disposed in a plurality of numbers, and the filament body 112 formed of a material having higher tensile strength properties, for example, an aramid fiber is disposed at a central portion of the wire for tensile measures and bending measures.

In an example of FIG. 4, a plurality of polyurethane wires are bound and coated. In this way, a number of polyurethane wires are prevented from being dispersed. The central portion of the polyurethane wire is formed of, for example, a copper wire.

The polyurethane coating is performed such that, for example, the wire 11-1 has a red color, the wire 11-2 has a green color, and the wire 11-3 has transparency.

These wires are disposed as the inner conductors in a plurality of pieces, for example, by L, R, and G for audio signal transmission.

In this manner, a plurality of inner conductors 11-1, 11-2, and 11-3 are respectively insulated by an insulator (for example, polyurethane), so that they can transmit a plurality of signals in a direct-current pattern.

Also, by spirally twisting and arranging a plurality of inner conductors, thereby combining them in terms of high-frequency, they can be regarded as one conductor at higher frequencies.

Also, as described above, as the filament body 112, an aramid fiber having a high tensile strength property and an excellent heat resistance property can be used. Since the aramid fiber can also be used as a reinforcing fiber of the inner conductor 11, common use of a used material can be realized.

In addition, as the aramid fiber, for example, a commercially available fiber such as Kevlar (the registered trademark of DuPont) or Twaron (the registered trademark of Teijin) can be used.

The first insulator 12 insulates the first outer conductor 13 from the inner conductor 11.

As the first insulator 12, thermoplastic resin such as vinyl chloride, polyethylene (PE), or polypropylene is used.

As the first insulator 12, it is preferable to use tetrafluoroethylene perfluoroalkyl vinyl ether copolymer (PFA) having excellent electric characteristics and heat resistance properties, or cross-linked foamed polyethylene having low dielectric constant or dielectric loss.

The first outer conductor 13 is wrapped around the outer circumference of the first insulator 12, and dielectric constant of the first insulator 12 is adjusted such that characteristic impedance by a coaxial structure of the inner conductor 11 and the first outer conductor 13 becomes 50Ω or 75Ω.

The second insulator 14 insulates the second outer conductor 15 from the first outer conductor 13.

As the second insulator 14, similarly to the first insulator 12, it is preferable to use tetrafluoroethylene perfluoroalkyl vinyl ether copolymer (PFA) having excellent electric characteristics and heat resistance property, or cross-linked foamed polyethylene having low dielectric constant or dielectric loss.

The second outer conductor 15 is wrapped around the outer circumference of the second insulator 14, and dielectric constant of the second insulator 14 is adjusted such that characteristic impedance by a coaxial structure of the first outer conductor 13 and the second outer conductor 15 becomes 50Ω or 75Ω.

As described above, it is preferable that the first insulator 12 and the second insulator 14 are made of a material having a low loss in terms of high-frequency, such as polyethylene or foamed polyethylene.

In this embodiment, the first outer conductor 13 and the second outer conductor 15 are formed of a braided shield which is braided by a plurality of electrically-conductive element wires, for example, a plurality of naked annealed copper wires.

In addition, in the braided shield, compared to a served shield, generation of clearances in the shield is small also at the time of bending, and the braided shield is known as an electrostatic shield method having appropriate flexibility, bending strength, and mechanical strength.

Figure 5:
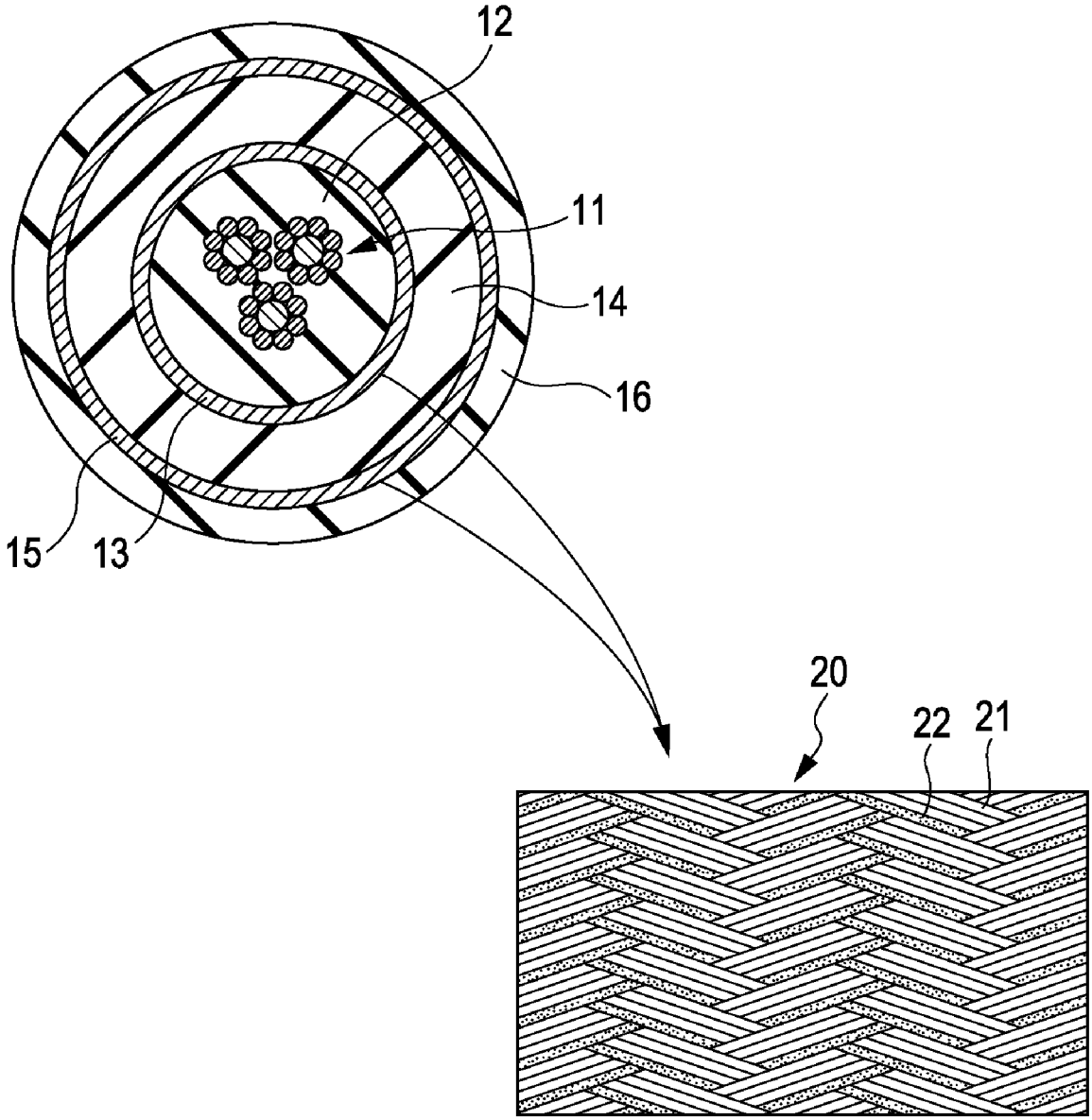
FIG. 5 is a diagram showing a formation example of a braided shield according to the embodiment.

FIG. 5 is a diagram showing a formation example of the braided shield according to this embodiment.

In the braided shield 20, usually, several element wires 21 are taken as one set, the number of sets is called the number of strikes, the number of element wires in one strike is expressed as the number of takings, and the total number of element wires corresponds to "the number of takings"×" the number of strikes".

In a braided shield of an ultrafine shielded cable, usually, the number of takings is 2 to 10 element wires, and the number of strikes is set to be 10 to 30 sets. In this embodiment, a portion out of the element wires 21 of the braided shield having such a configuration is formed of the filament body 22 of a material having higher tensile strength properties.

The filament body 22 has an outer diameter or thickness, which is approximately the same as that of the element wire 21 constituting the braided shield 20, and is woven into the braided shield 20 in the same manner as the interweaving of the element wires 21.

In this case, for example, if the number of takings is 4, one piece out of the element wires 21 is replaced with the filament body 22, so that ¼ of the whole of the braided shield 20 is the filament body 22.

In addition, as the filament body 22 of a material having higher tensile strength properties than that of the element wire 21 constituting the braided shield 20, any of a metallic wire and a nonmetallic wire may be used.

Also, in a case where, for example, an alloy wire is used as the filament body 22, it is also acceptable that plating or the like having good conductivity is deposited on the metallic wire so as to secure a shield characteristic.

Also, in a case where a nonmetallic wire such as a high-tensile fiber is used as the filament body 22, it is also acceptable to use, for example, a filament body such as a metalized fiber constituted by coating copper or the like on the surface of a high-tensile fiber, or a copper foil yarn constituted by wrapping a rectangular linear copper foil tape around a high-tensile fiber yarn.

Also, in a case where the insulation sheath 16 is formed by molding from an extruder, since heating is involved, a filament body having heat resistant properties is used as the filament body 22.

In this manner, in the first embodiment, shields made using naked annealed copper wires are formed around the first insulator 12 and the second insulator 14.

The shields have a structure braided by the naked annealed copper wires, as described above. By braiding, the coupling between the conductors is further advanced in terms of high-frequency, and even if they are interwoven, they can be regarded as one conductor, so that a high-frequency loss can be further reduced.

In the case of a served shield, shield performance inevitably varies in accordance with a winding pitch, and as the number of windings increases, shielding performance is improved, while flexibility deteriorates.

By interweaving, a structure is obtained in which although clearances are supplemented, flexibility is hardly affected.

The insulation sheath 16 (there is also a case where it is called an outer covering or a jacket) is formed, for example, by molding resin such as styrene elastomer by an extruder.

Figures 6A, 6B:
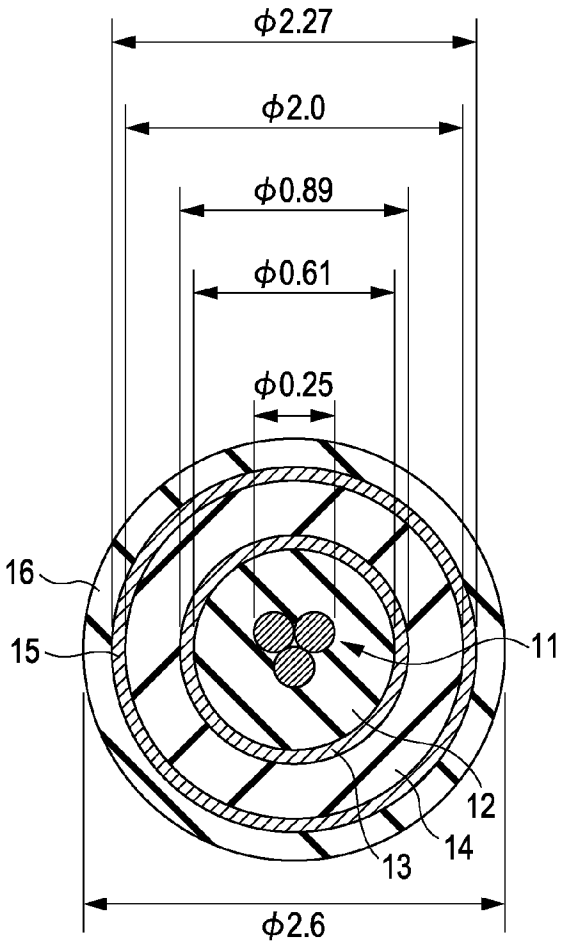
FIGS. 6A and 6B are diagrams showing examples of the materials, the outer diameters, and so on of the respective constituent members of the shielded cable according to the first embodiment.

FIGS. 6A and 6B are diagrams showing examples of the materials, the outer diameters, and so on of the respective constituent members of the shielded cable according to the first embodiment.

FIG. 6A is a table showing the materials, the outer diameters, and so on of the respective constituent members of the shielded cable.

FIG. 6B is a diagram showing dimensions of the outer diameters of the respective constituent members of the shielded cable.

In FIGS. 6A and 6B, the outer diameter Φ of the inner conductor 11 is set to be 0.25 mm.

The outer diameter Φ of the first insulator 12 is set to be 0.61 mm.

In this case, the thickness of the first insulator 12 is approximately 0.36 mm. The standard thickness of the first insulator 12 is 0.14 mm.

The outer diameter Φ of the first outer conductor 13 is set to be 0.89 mm.

In this case, the thickness of the first outer conductor 13 is approximately 0.28 mm.

The outer diameter Φ of the second insulator 14 is set to be 2.0 mm.

In this case, the thickness of the second insulator 14 is approximately 1.11 mm. The standard thickness of the second insulator 14 is 0.56 mm.

The outer diameter Φ of the second outer conductor 15 is set to be approximately 2.27 mm.

In this case, the thickness of the second outer conductor 15 is 0.27 mm.

The outer diameter Φ of the insulation sheath 16 is set to be approximately 2.6 mm.

In this case, the thickness of the insulation sheath 16 is 0.33 mm. The standard thickness of the insulation sheath 16 is 0.17 mm.

Next, a shielded cable structure associated with high-frequency impedance of the shielded cable 10 according to the first embodiment is considered.

Figure 7A:
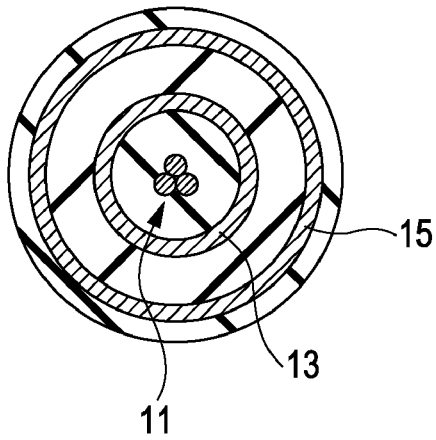
FIGS. 7A to 7C are diagrams showing a passage loss measurement system of the shielded cable (coaxial cable)
Figure 7B:
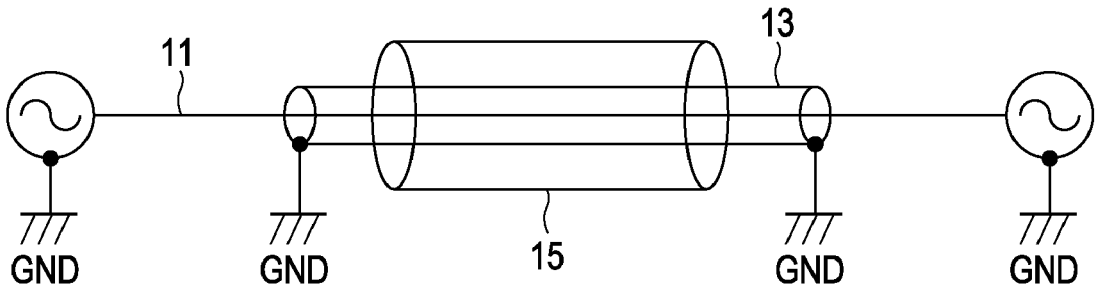
Figure 7C:
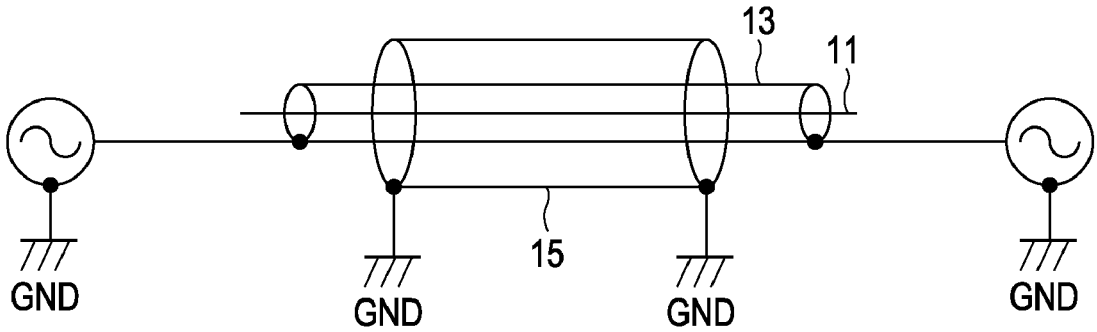

FIGS. 7A to 7C are diagrams showing a passage loss measurement system of the shielded cable (coaxial cable).

FIG. 7A is a diagram showing an object of passage loss measurement.

FIG. 7B is a diagram showing an equivalent circuit of a passage loss measurement system of the inner conductor and the first outer conductor (braided shield 1).

FIG. 7C is a diagram showing an equivalent circuit of a passage loss measurement system of the first outer conductor (braided shield 1) and the second outer conductor (braided shield 2).

FIGS. 8A to 8D are diagrams showing a passage loss of the inner conductor and the first outer conductor.

FIGS. 9A to 9D are diagrams showing a passage loss of the first outer conductor and the second outer conductor.

In these drawings, the inner conductor 11 is stated as a central conductor, the first outer conductor 13 is stated as a coaxial braid A, and the second outer conductor 15 is stated as a coaxial braid B.

A conductor structure is determined in consideration of high-frequency impedance between the central inner conductor 11 and the first insulator 12.

Here, FIGS. 7B, and 8A to 8D show an example designed such that impedance between the inner (central) conductor 11 and the first outer conductor (braided shield 1, coaxial braid A) 13 is 50Ω.

A passage loss of a coaxial cable having a length of 100 mm was measured.

In a case where the diameter of the inner (central) conductor 11 is approximately Φ0.6 mm and a dielectric constant ∈r of polyethylene of the first insulator 12 is 2 (∈r=2), high-frequency impedance of 50Ω can be obtained by making the diameter of the first outer conductor (braided shield 1, coaxial braid A) to be approximately 0.9 mm.

In addition, by forming the first insulator 12 by foamed polyethylene, it is possible to lower specific inductive capacity, reduce a wavelength shortening effect, and lower a dielectric loss.

Also, softness of the insulator is improved, so that flexibility is improved.

Next, the second insulator 14 is disposed around the first outer conductor (braided shield 1).

Subsequently, the second outer conductor (braided shield 2) 15 is disposed around the second insulator 14.

With respect to the second outer conductor (braided shield 2, coaxial braid B), in a case where two conductors, the first outer conductor (braided shield 1) and the second outer conductor (braided shield 2) 15, are considered, it can be considered as being a coaxial structure, as shown in FIG. 7C.

By considering the first outer conductor (braided shield 1) 13 as a central conductor, and configuring the second outer conductor (braided shield 2) 15 as a shield wire for the central conductor, a coaxial transmission line can be constructed, as shown in FIG. 7C.

In this case, when the diameter of the central conductor (braided shield 1) is set to be (Φ0.9 mm, by making the shield to be Φ2.3 mm through the dielectric (second insulator 14), a function as a coaxial cable having characteristic impedance of about 50Ω can be obtained, as shown in FIGS. 9A to 9D.

Finally, by disposing an outer covering made of elastomer, which is an insulator, around the second outer conductor (braided shield 2), a cable is completed.

As explained above, the shielded cable 10 of this embodiment include the inner conductor 11, the first insulator 12, the first outer conductor 13, the second insulator 14, and the second outer conductor 15, which are coaxially disposed in this order from an inner side, and is covered at its outer circumference by the insulation sheath 16.

The inner conductor 11 includes a plurality of element wires 111, and a filament body 112 formed using a material having higher tensile strength properties than that of the element wire in a portion of the element wires 111.

The first outer conductor 13 and the second outer conductor 15 are formed by braided shields which are braided by a plurality of electrically conductive element wires.

Therefore, according to the shielded cable of this embodiment, the following effects can be obtained.

That is, the shielded cable of this embodiment can be manufactured at a low price.

Also, the shielded cable can realize improvement in design property, and improvement in flexibility (flexure and tension of the cable, and simplification of a structure).

Further, the shielded cable of this embodiment can realize a shielded antenna cable which is low in price, and excellent in design property and flexibility, and further, realize improvement in high-frequency characteristic.

In addition, a case where the shielded cable according to this embodiment is used as the shielded antenna cable will be described in detail later.

2. Second Embodiment

FIGS. 10A, 10B, 11A, and 11B are diagrams showing a structure example of a shielded cable according to a second embodiment of the present invention.

Figure 10A:
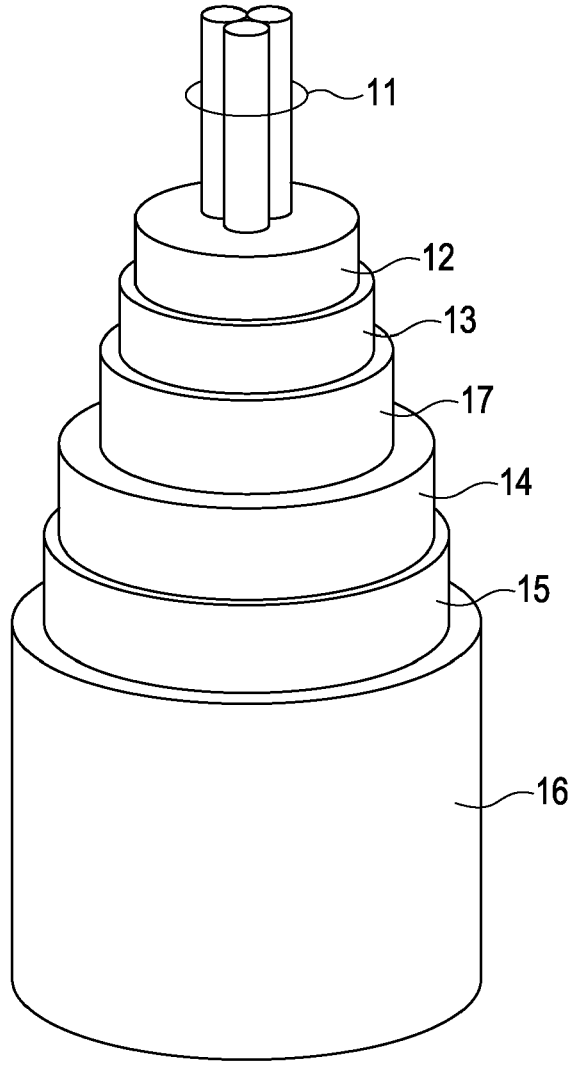
FIGS. 10A and 10B are first diagrams showing a structure example of a shielded cable according to a second embodiment of the present invention.
Figure 10B:
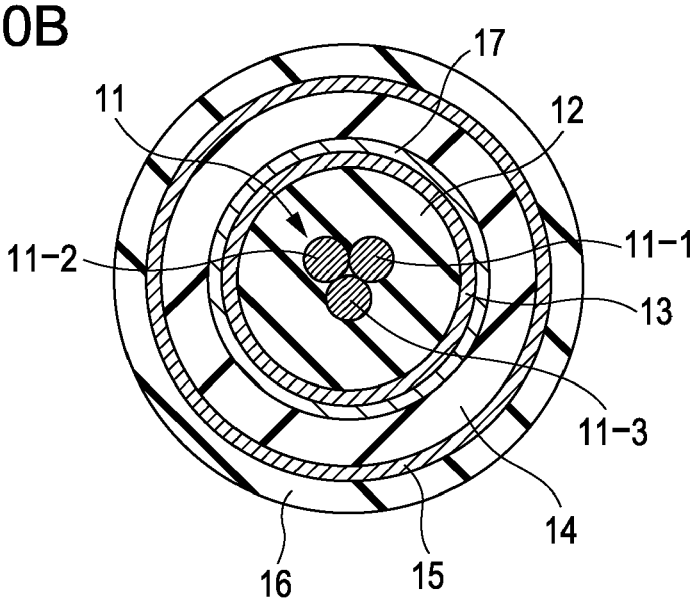

FIG. 10A is a perspective view showing each constituent member of the shielded cable according to the second embodiment in an exposed state. FIG. 10B is a simple cross-sectional view of the shielded cable according to the second embodiment.

Figure 11B:
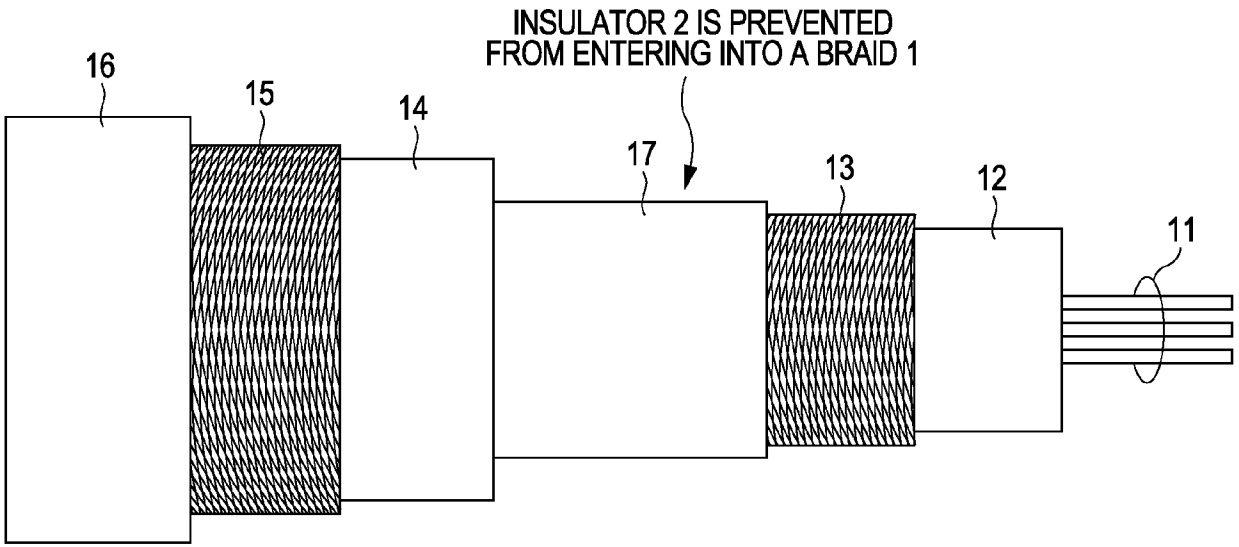
FIGS. 11A and 11B are second diagrams showing a structure example of the shielded cable according to the second embodiment of the present invention.
Figure 11A:
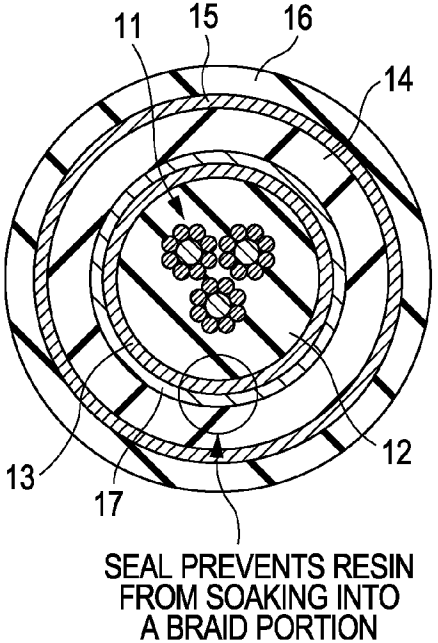

FIG. 11A is a simple cross-sectional view of the shielded cable according to the second embodiment. FIG. 11B is a side view showing each constituent member of the shielded cable according to the second embodiment in an exposed state.

Differences between the shielded cable 10A according to the second embodiment and the shielded cable 10 according to the first embodiment are as follows.

That is, the shielded cable 10A according to the second embodiment is configured such that a coupling state of the second insulator 14 and the first outer conductor 13 is equal to or coarser than a coupling state of the second insulator 14 and the second outer conductor 15.

In the shielded cable 10A shown in FIGS. 10A, 10B, 11A, and 11B, a seal film 17 is disposed between the second insulator 14 and the first outer conductor 13.

The reason to dispose the seal film 17 between the second insulator 14 and the first outer conductor 13 is explained below.

Figure 12A:
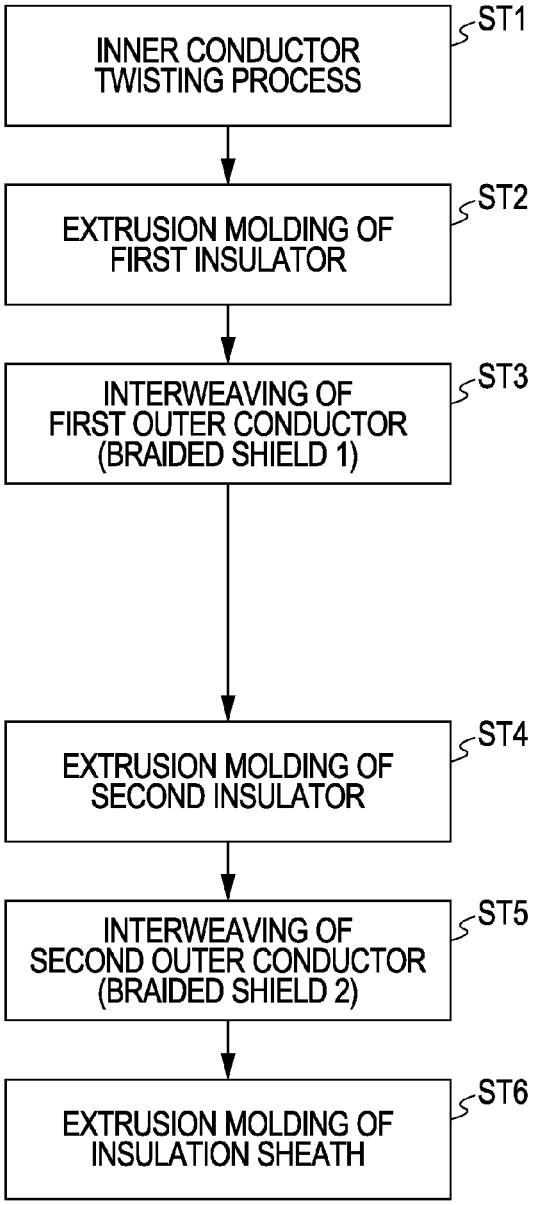
FIGS. 12A and 12B are diagrams showing a manufacturing process of the shielded cable shown in FIGS. 1A and 1B and a manufacturing process of the shielded cable shown in FIGS. 10A and 10B in contradistinction to each other.

The shielded cable 10 shown in FIGS. 1A, 1B, 2A, and 2B can realize a double shield structure by coaxially disposing the inner conductor 11, the first insulator 12, the first outer conductor 13, the second insulator 14, and the second outer conductor 15, and a manufacturing process thereof is the same as that shown in FIG. 12A.

A first step ST1 is a process which twists the inner conductor 11.

A second step ST2 is the extrusion molding process of the first insulator 12.

A third step ST3 is a process which interweaves the first outer conductor (braided shield) 13.

A fourth step ST4 is the extrusion molding process of the second insulator 14.

A fifth step ST5 is a process which interweaves the second outer conductor (braided shield) 15.

A sixth step ST6 is the extrusion molding process of the insulation sheath 16.

In the manufacturing process described above, in the fourth step ST4, the extrusion molding process of the second insulator 14 is carried out at a temperature raised up to about 250° C.

As described above, in a case where the second insulator 14 is formed of polyethylene, there is a fear that the following trouble will occur.

That is, since a melting point of polyethylene (PE) is 110° C., in a case where the second insulator 14 is formed around the first outer conductor (braided shield 1) 13 by extrusion molding, there is a case where melted resin soaks into an interwoven portion of the braid, so that adhesion strength excessively rises.

In a case where such a state occurs, drawing-out work of electric wires for performing a terminal treatment, for example, a soldering treatment, of the braided shield becomes difficult.

Figure 12B:
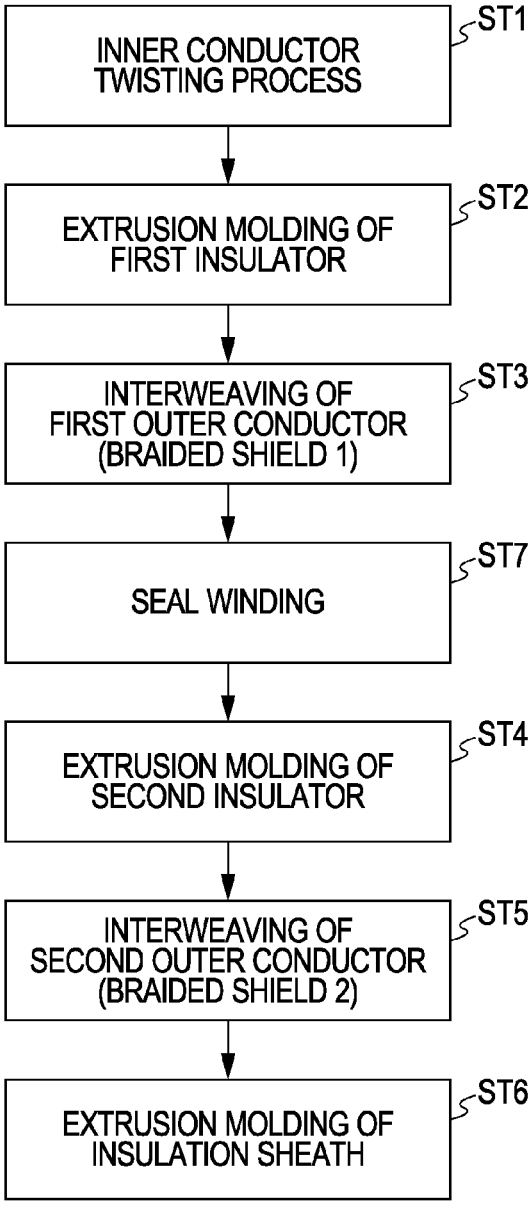

Therefore, in the second embodiment, as shown in FIG. 12B, after the third step ST3, the process which interweaves the first outer conductor (braided shield) 13, as a seventh step ST7, the process of winding a seal film on the first outer conductor (braided shield 1) 13 is provided.

After this process, the fourth step ST4, the extrusion molding process of the second insulator 14, is performed.

In this manner, by winding the seal film 17 on the first outer conductor (braided shield 1) 13 in order to prevent resin from soaking into the braid, the film can play a role to prevent the flow of resin to the braided shield, so that terminal work becomes easier.

By winding the seal film 17 on the first outer conductor (braided shield 1) 13, the flow of resin to the braided shield can be reliably prevented.

However, the seal film 17 is not necessarily provided.

For example, in a case where PET having a melting point of 264° C. is used as the second insulator 14, in the fourth step ST4, the extrusion molding process of the second insulator 14, the second insulator 14 is not melted even at a temperature raised up to about 250° C.

Also, even if resin flows to the first outer conductor 13 by the use of polyethylene as the first insulator 12, and even if the flow of resin is prevented by using PET, influence on the terminal work is small.

In this case, even if the seal film 17 is not provided, a configuration can be made such that the coupling state of the second insulator 14 and the first outer conductor 13 is equal to or coarser than the coupling state of the second insulator 14 and the second outer conductor 15.

According to the second embodiment, in addition to the above-described effects of the first embodiment, the flow of resin to the braided shield can be prevented, so that there is an advantage in that terminal work becomes easier.

Next, configuration examples of the antenna devices in which the shielded cables 10 and 10A according to the first and second embodiments are applied are explained. Thereafter, characteristics of the antenna device in which the shielded cable according to this embodiment is applied are considered including the comparison with an ordinary rod antenna, a dipole antenna, and the like.

First, three configuration examples of the antenna devices in which the shielded cables 10 and 10A according to the first and second embodiments are applied are explained as a third embodiment, a fourth embodiment, and a fifth embodiment.

3. Third Embodiment

Figure 13A:
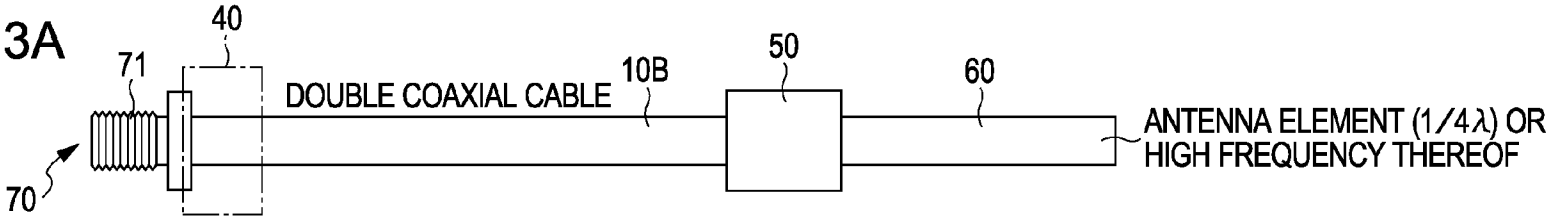
FIGS. 13A to 13C are diagrams showing a configuration example of an antenna device according to a third embodiment of the present invention.
Figure 13B:
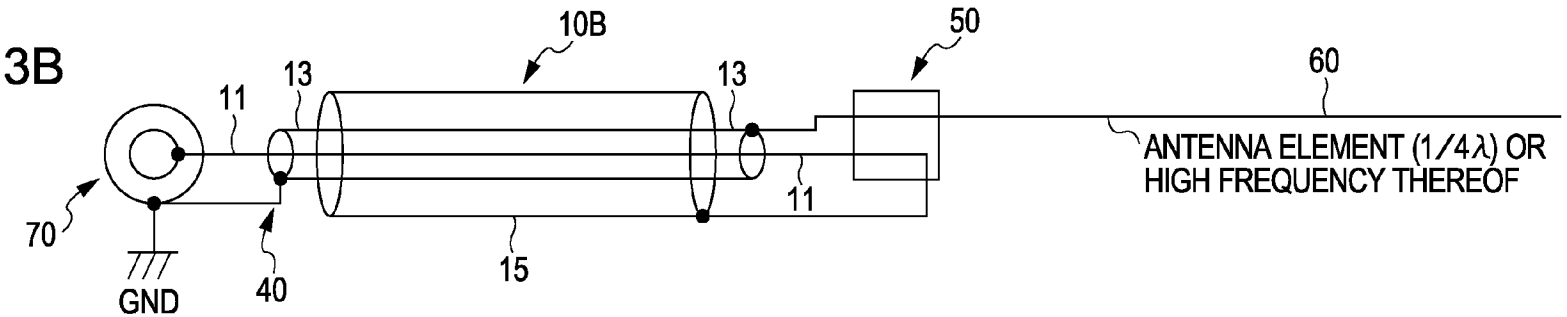
Figure 13C:
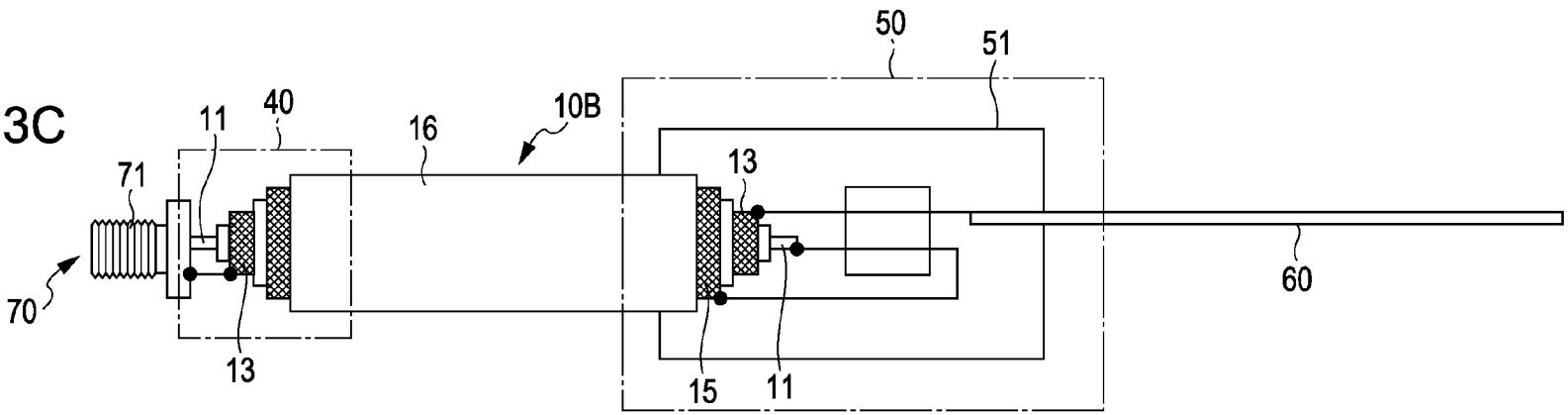

FIGS. 13A to 13C are diagrams showing a configuration example of the antenna device according to the third embodiment of the present invention.

FIG. 13A is a diagram showing a constructive concept of the antenna device according to the third embodiment.

FIG. 13B is a diagram showing an equivalent circuit of the antenna device according to the third embodiment.

FIG. 13C is a diagram showing a specific configuration example of the antenna device according to the third embodiment.

In the antenna device 30, basically, the shielded cables 10 and 10A according to the first and second embodiments are applied as a shielded antenna cable 10B of the antenna.

Therefore, in the shielded antenna cable 10B shown in FIGS. 13A to 13C, the same constituent portions as those of the shielded cables 10 and 10A are denoted by the same reference numbers.

In the antenna device 30, the shielded antenna cable 10B has a first connection portion 40 on one end side and a second connection portion 50 on the other end side.

Also, the antenna device 30 has an antenna element 60 which is connected to the other end side of the shielded antenna cable 10B by the second connection portion 50.

The shielded antenna cable 10B is a cable which is connected to an electronic device, and the whole or a portion of the shielded antenna cable 10B functions as an antenna for receiving a radio or television signal.

Also, as described above, the shielded antenna cable 10B includes the inner conductor 11, the first insulator 12, the first outer conductor 13, the second insulator 14, and the second outer conductor 15, which are coaxially disposed in this order from an inner side, and is covered at its outer circumference by the insulation sheath 16.

That is, in the shielded cable 10, the inner conductor 11 is insulated by the first insulator 12, and the first outer conductor 13 is coaxially disposed on the outer circumference of the first insulator 12. Further, in the shielded cable 10, the first outer conductor 13 is insulated by the second insulator 14, and the second outer conductor 15 is disposed on the outer circumference of the second insulator 14.

In the shielded cable 10, the whole of the outer circumference thereof is coated by the insulation sheath 16.

Then, the inner conductor 11, the first outer conductor 13, the first outer conductor 13, and the second outer conductor 15 have impedance in terms of high-frequency.

The first connection portion 40 is formed as a connector, which is connected to a terminal 71 of a receiver (tuner) 70 of an electronic device, on one end side of the shielded antenna cable 10B.

The first connection portion 40 is formed such that, for example, when the connection portion is connected to the terminal 71 of the receiver 70, the inner conductor 11 is supplied with power and the first outer conductor 13 is connected to a ground GND of the receiver 70.

That is, in an example shown in FIGS. 13A to 13C, in the first connection portion 40, the inner conductor 11 is connected to a power feed circuit of the receiver 70 of the electronic device and the first outer conductor 13 of the cable is connected to the ground GND of the receiver 70, so that the shielded antenna cable 10B functions as an unbalanced transmission path.

The second connection portion 50 has a connection substrate (printed substrate) 51, and connects the other end side of the shielded antenna cable 10B and the antenna element 60.

In the second connection portion 50, the first outer conductor 13 of the shielded antenna cable 10B is connected to the antenna element 60, and the inner conductor 11 is connected to the second outer conductor 15.

The first connection portion 40 and the second connection portion 50 are formed by molding, or as case bodies.

The antenna device 30 is designed such that with respect to the double shielded cable 10B, as described above, a transmission line is constructed between the inner conductor 11 and the first outer conductor 13 and impedance is, for example, 50Ω.

Also, a coaxial structure is similarly constructed between the first outer conductor 13 and the second outer conductor 15 of the double shielded cable 10B.

By adjusting a length between the first outer conductor 13 and the second outer conductor 15, impedance of the coaxial cable can be easily controlled.

Then, by using the coaxial structure according to this embodiment, a high-frequency trap by the coaxial cable can be configured.

According to the third embodiment, since the shielded cables 10 and 10A according to the first and second embodiments are applied as the shielded antenna cables 10B of the antenna, it is possible to configure the antenna device which is not affected by a set side, as will be described in detail later.

Also, with just a terminal treatment of the cable, a sleeve portion can be configured, so that the sleeve portion can be configured without using a sheet metal, or a sleeve element as a separate part. Therefore, the sleeve portion can be configured very simply and at a low price and designed in accordance with only the thickness of the cable and a balance pace.

Also, since it is not necessary to form the antenna into a T-shape like a dipole antenna, the configuration of the component also becomes simpler, and the antenna can be used as a linear antenna.

4. Fourth Embodiment

Figure 14A:
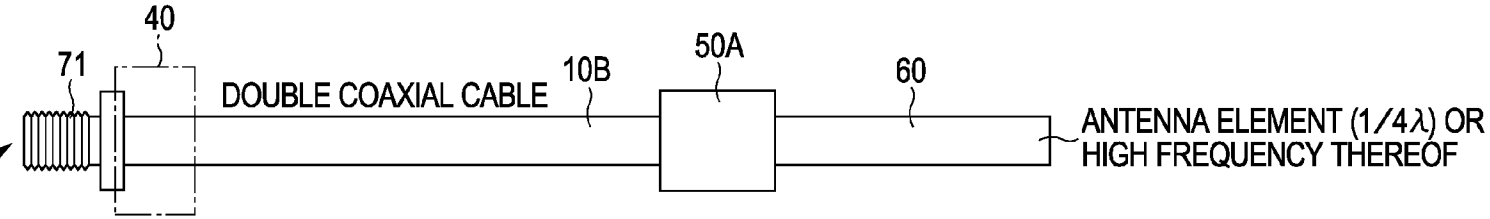
FIGS. 14A to 14C are diagrams showing a configuration example of an antenna device according to a fourth embodiment of the present invention.
Figure 14B:
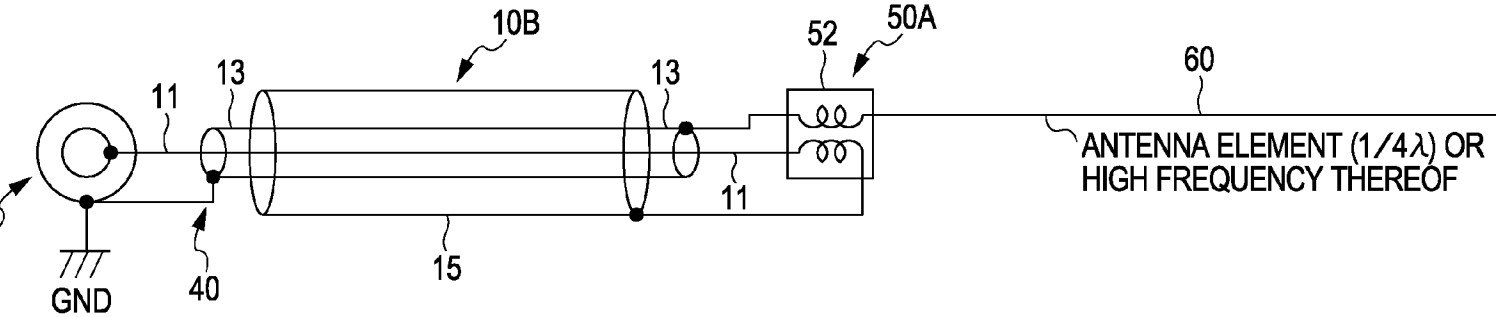
Figure 14C:
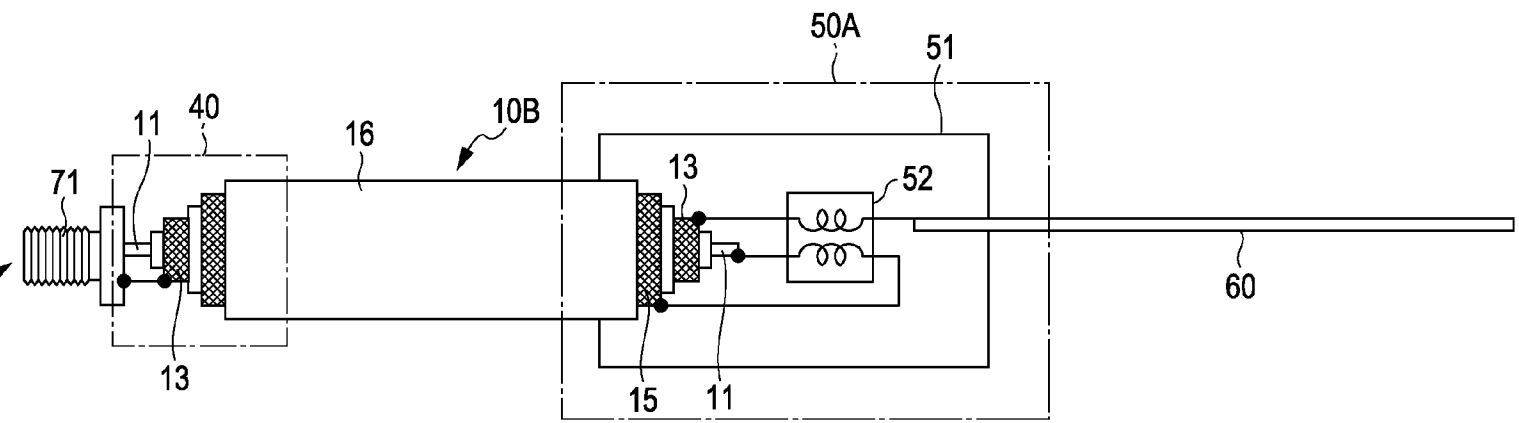

FIGS. 14A to 14C are diagrams showing a configuration example of the antenna device according to a fourth embodiment of the present invention.

FIG. 14A is a diagram showing a constructive concept of the antenna device according to the fourth embodiment.

FIG. 14B is a diagram showing an equivalent circuit of the antenna device according to the fourth embodiment.

FIG. 14C is a diagram showing a specific configuration example of the antenna device according to the fourth embodiment.

The antenna device 30A of the fourth embodiment is different from the above-described antenna device 30 of the third embodiment in that in a second connection portion 50A, the other end of a shielded antenna cable 10B is connected to the antenna element 60 through a balance-unbalance converter (balun) 52.

Specifically, the inner conductor 11 and the first outer conductor 13 of the shielded antenna cable 10B are connected to the balun 52.

One terminal of the balun 52 is connected to the second outer conductor 15 of the shielded antenna cable 10B, and the other terminal of the balun 52 is connected to the antenna element 60.

The first outer conductor 13 is connected to the antenna element 60 through the balun 52, and the inner conductor 11 is connected to the second outer conductor 15 through the balun 52.

The balun 52 is mounted on the printed substrate (connection substrate) 51, and then, the cable is connected to a land of the printed board 51, so that wiring as an antenna device can be completed. In this manner, this mounting structure has a very simple structure.

In addition, the balun element is not limited to a 1:1 structure, but, for example, a 1:4 structure is also acceptable.

According to the fourth embodiment, since the balun 52 is applied in addition to the configuration of the third embodiment, it is possible to configure the antenna device which is not further affected by a set side, as will be described in detail later.

Figure 15:
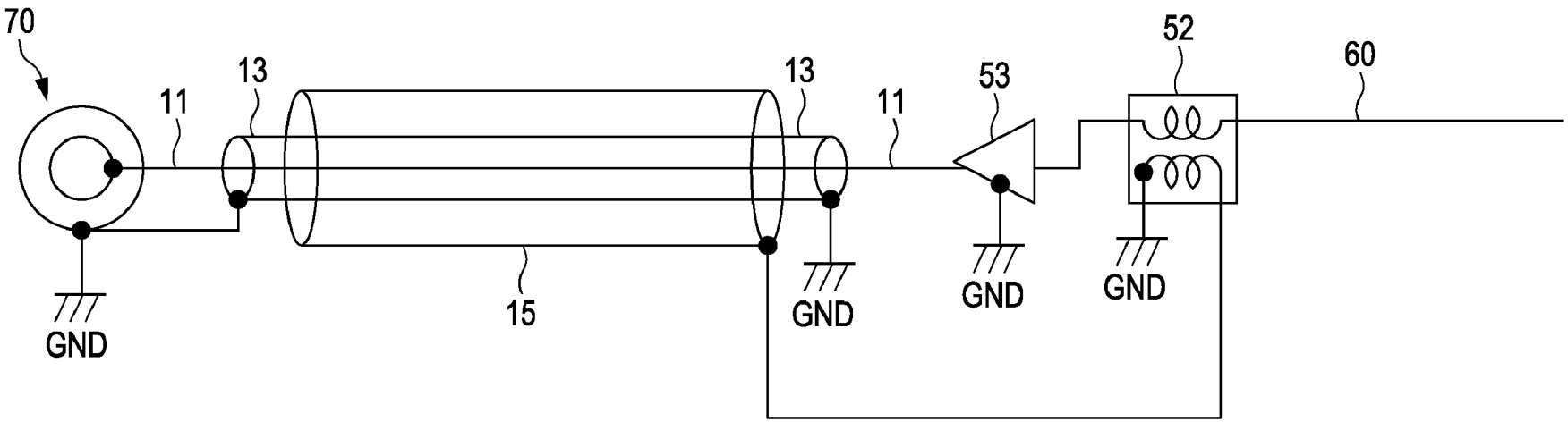
FIG. 15 is a diagram showing another configuration example of the antenna device according to the fourth embodiment of the present invention.

In addition, as shown in FIG. 15, it is also possible to dispose an amplifier 53 between the balun 52 and the inner conductor 11.

In this case, one terminal of the balun 52, which is connected to the antenna element 60, is connected to an input of the amplifier 53, and an output of the amplifier 53 is connected to the inner conductor 11.

Also, the first outer conductor 13 is connected to a ground GND.

One end of the other terminal of the balun 52 is connected to the ground GND, and the other end is connected to the second outer conductor 15.

In this manner, by disposing the amplifier 53, improvement in receiver sensitivity can be realized.

5. Fifth Embodiment

Figures 16A, 16B, 16C:
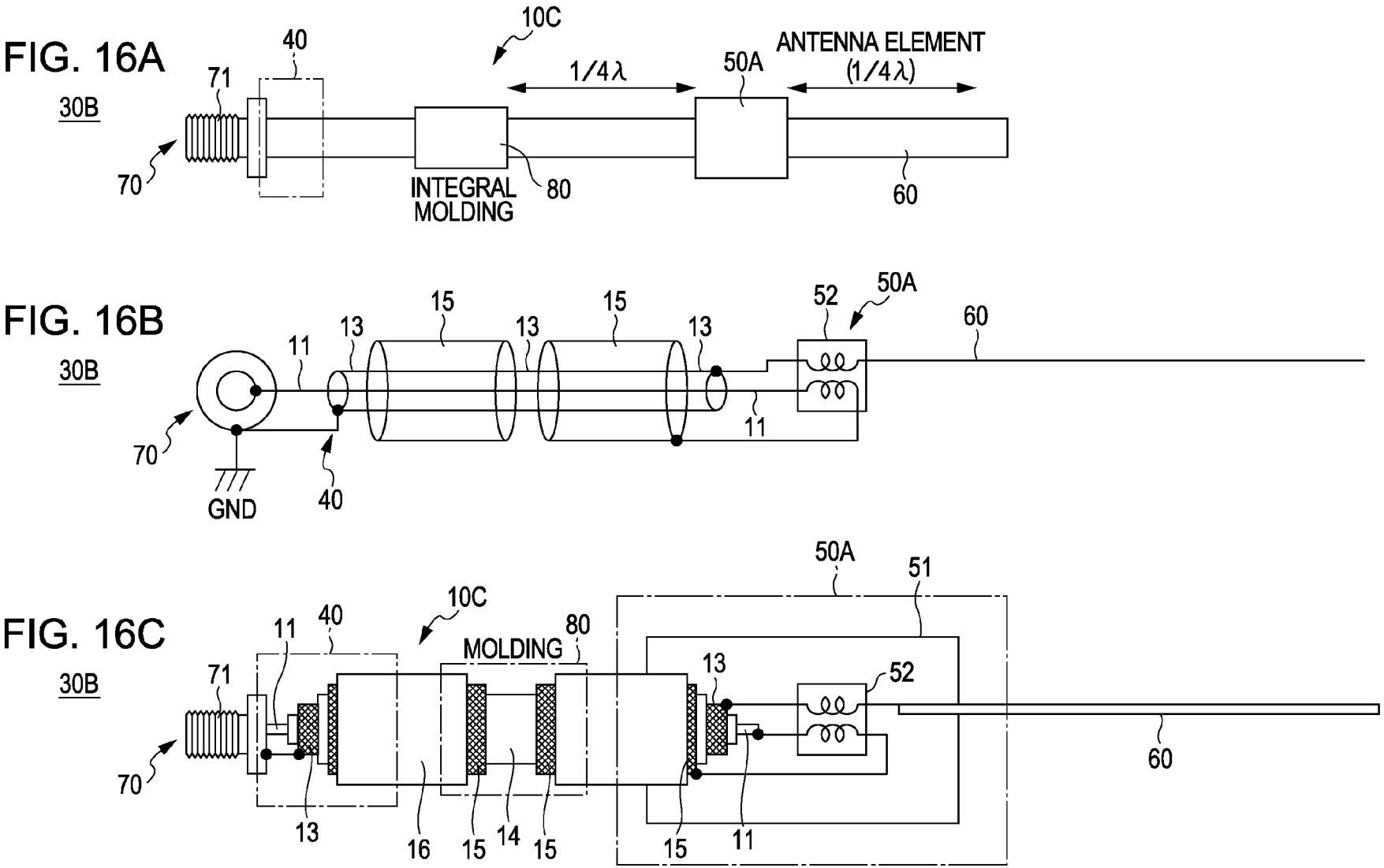
FIGS. 16A to 16C are diagrams showing a configuration example of an antenna device according to a fifth embodiment of the present invention.

FIGS. 16A to 16C are diagrams showing a configuration example of the antenna device according to a fifth embodiment of the present invention.

FIG. 16A is a diagram showing a constructive concept of the antenna device according to the fifth embodiment.

FIG. 16B is a diagram showing an equivalent circuit of the antenna device according to the fifth embodiment.

FIG. 16C is a diagram showing a specific configuration example of the antenna device according to the fifth embodiment.

The antenna device 30B of the fifth embodiment is different from the above-described antenna device 30A of the fourth embodiment in that an shielded antenna cable 10C has at a portion thereof in a longitudinal direction a removed portion 80, in which the insulation sheath 16 and the second outer conductor 15 are removed.

Here, a portion in a longitudinal direction of the shielded antenna cable 10C is a position which is spaced $(n\lambda)/2$ from the other end of the cable, wherein $\lambda$ is a wavelength.

In FIGS. 16A to 16C, the antenna element 60 is $(1/4)\lambda$, and the removed portion 80 is formed at a position of $(1/4)\lambda$ from the other end portion of the balun 52.

Specifically, the removed portion 80 is formed at a position of 160 mm from the other end.

According to the fifth embodiment, in addition to the effects of the fourth embodiment, it is possible to adjust a frequency of the antenna device.

[Characteristics of Antenna Device]

Hereinafter, characteristics, etc. of the antenna device in which the shielded cable according to this embodiment is applied are considered including the comparison with an ordinary rod antenna, a dipole antenna, and the like.

First, features in a case where the shielded cable according to this embodiment is applied to the antenna device are explained in comparison with the rod antenna, etc.

Figure 17A:
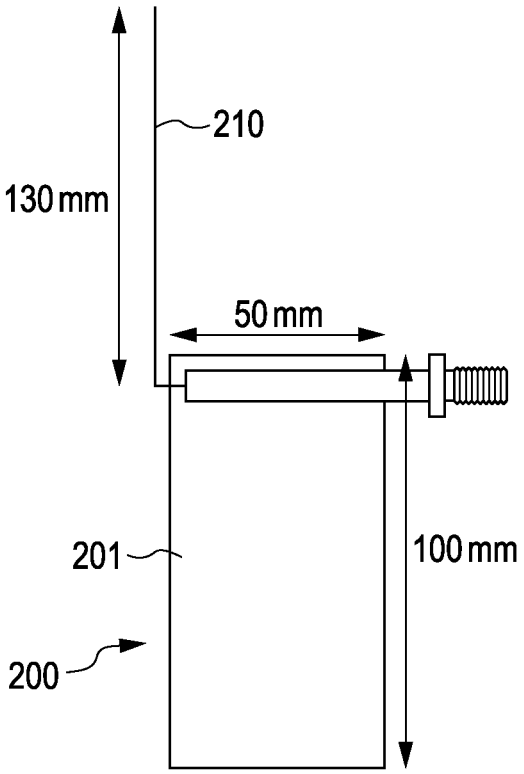
FIGS. 17A and 17B are diagrams showing a mobile telephone in which a rod antenna is applied.
Figure 17B:
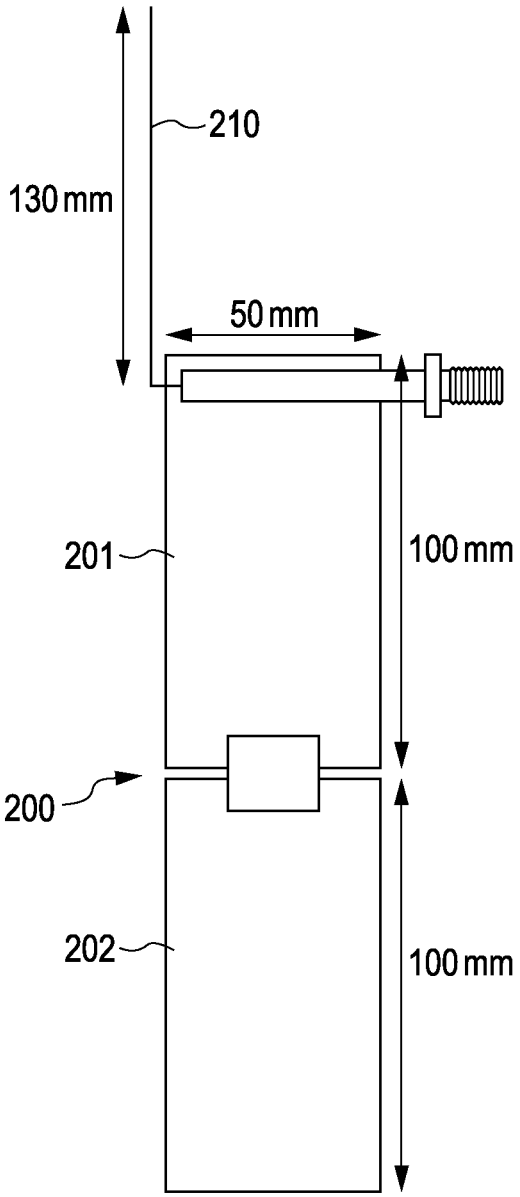

FIGS. 17A and 17B are diagrams showing a mobile telephone in which the rod antenna is applied.

FIG. 17A shows a case where a main body of the mobile telephone is closed, and FIG. 17B shows a case where the main body of the mobile telephone is opened.

A mobile telephone 200 is configured so as to be able to open and close a first housing 201 and a second housing 202.

The example shown in FIGS. 17A and 17B is an example in which a rod antenna 210 of 130 mm is used.

Figure 18A:
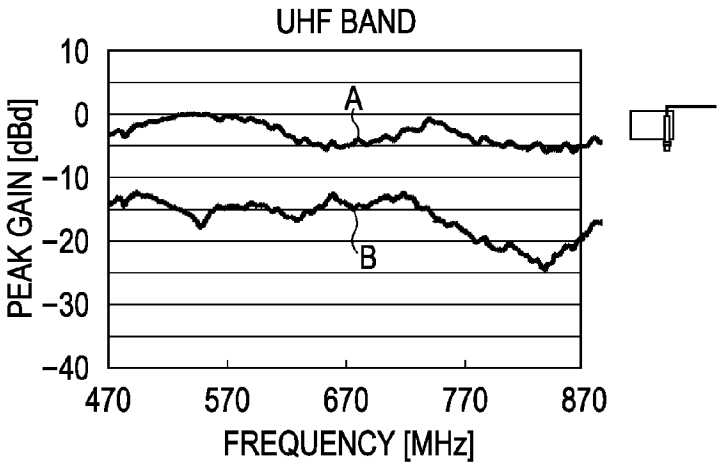
FIGS. 18A and 18B are diagrams showing the relationship between frequency and peak gain characteristics in a case where the mobile telephone in which a rod antenna is applied is closed.
Figure 18B:
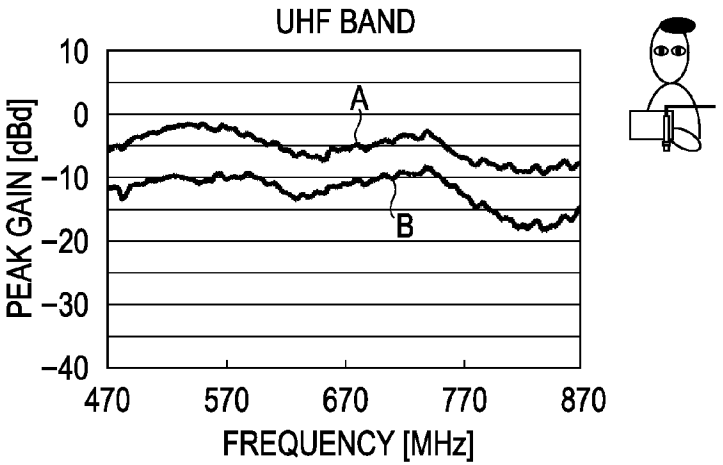

FIGS. 18A and 18B are diagrams showing the relationship between frequency and peak gain characteristics in a case where the mobile telephone in which the rod antenna is applied is closed. FIG. 18A shows the characteristics in a free space, and FIG. 18B shows the characteristics in a case where the mobile telephone is mounted on a human body.

Figure 19A:
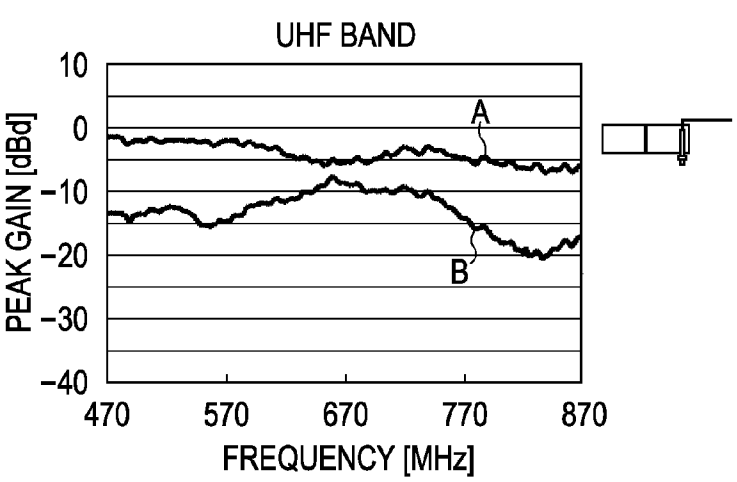
FIGS. 19A and 19B are diagrams showing the relationship between frequency and peak gain characteristics in a case where the mobile telephone in which a rod antenna is applied is opened.
Figure 19B:
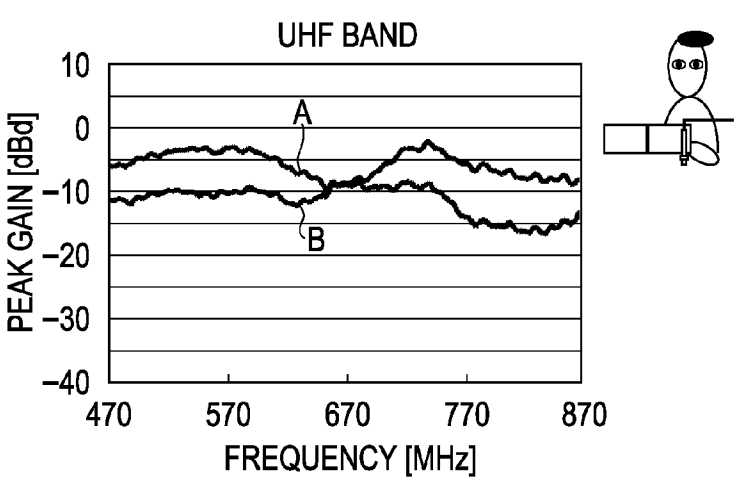

FIGS. 19A and 19B are diagrams showing the relationship between frequency and peak gain characteristics in a case where the mobile telephone in which the rod antenna is applied is opened. FIG. 19A shows the characteristics in a free space, and FIG. 19B shows the characteristics in a case where the mobile telephone is mounted on a human body.

In FIGS. 18A, 18B, 19A, and 19B, a curved line indicated by "A" shows the characteristic of horizontal polarization, and a curved line indicated by "B" shows the characteristic of vertical polarization.

An antenna which is used in a mobile telephone, etc. is an antenna of a ¼ monopole system, which is typified by the rod antenna 210 as shown in FIGS. 17A and 17B.

This antenna is an antenna which functions as an antenna by performing resonance by using the rod antenna and the set ground GND. In the case of the rod antenna 210, wide-band and gain are excellent, so that there is no problem.

However, in the case of this example, as shown in FIGS. 18A, 18B, 19A, and 19B, when the mobile telephone 200 is supposed, the antenna has an appropriate size to a resonance frequency of a UHF band, so that it is optimum. However, since the ground GND of the set is used as an antenna, there is also a problem in that a characteristic is affected by a size of the ground GND of the set.

Also, in a case where a noise of the set is large, there is a problem in that sensitivity deteriorates due to the reception of a self-radiated noise.

Figure 20:
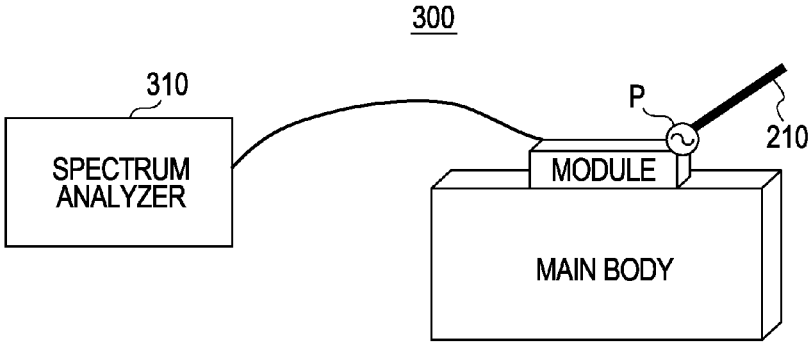
FIG. 20 is a diagram showing one example of a noise measurement system in the case of a rod antenna system.

FIG. 20 is a diagram showing one example of a noise measurement system in the case of a rod antenna system.

Figure 21B:
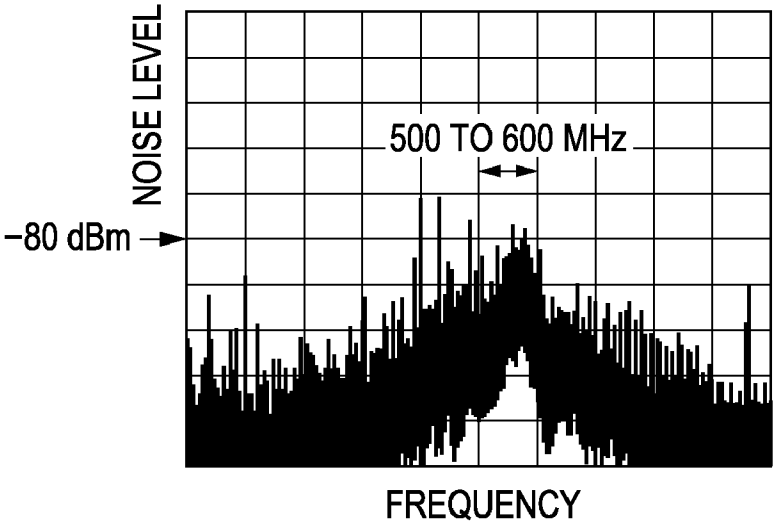
FIGS. 21A and 21B are diagram showing noise measurement results in the case of the rod antenna system.
Figure 21A:
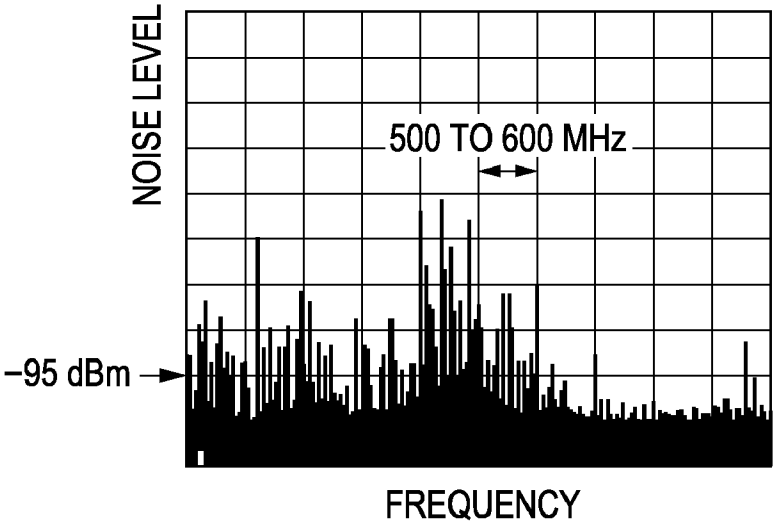

FIGS. 21A and 21B are diagram showing noise measurement results in the case of the rod antenna system. FIG. 21A shows noise measurement results at the time of power-off, and FIG. 21B shows noise measurement results at the time of power-on.

A noise measurement system 300 has a spectrum analyzer 310.

As shown in FIGS. 21A and 21B, in the case of the rod antenna system, the set receives a self-radiated noise by the antenna.

If set noise measures are taken and the set ground GND is optimized, the rod antenna is a very good antenna. However, it can be found that the antenna is also an antenna in which measures of the set side is necessary.

On the contrary, as an antenna in which influence of the set is reduced as much as possible, there is a sleeve antenna.

In the case of the sleeve antenna, by keeping a power feed point P of the antenna clear of a main body by a coaxial wire, a structure in which a set noise source is kept away from the antenna can be realized, so that it is possible to improve receiving performance by the improvement of C/N.

Figure 22:
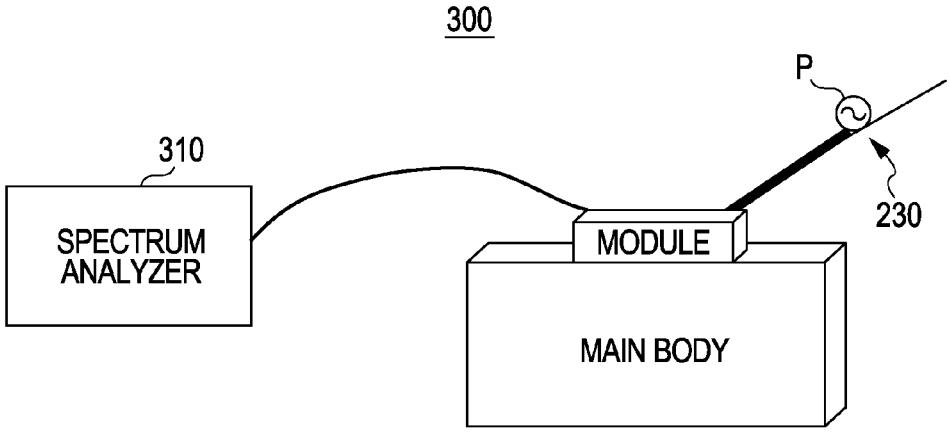
FIG. 22 is a diagram showing one example of a noise measurement system in the case of a sleeve antenna system.

FIG. 22 is a diagram showing one example of a noise measurement system in the case of a sleeve antenna system.

Figure 23B:
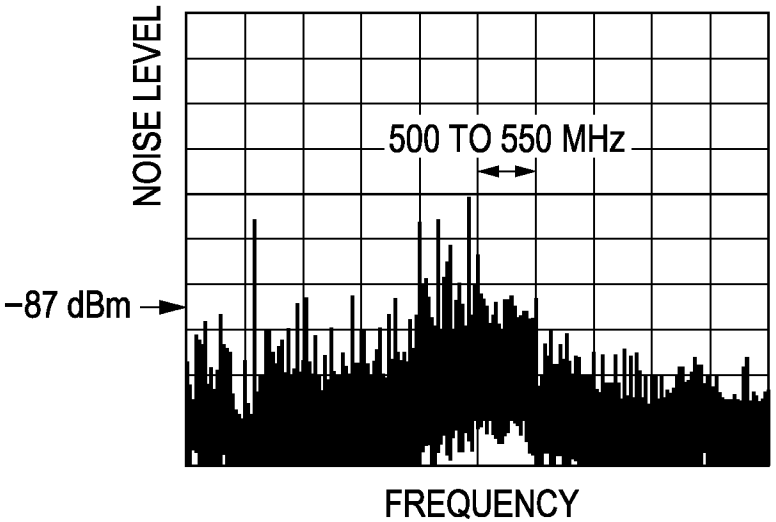
FIGS. 23A and 23B are diagram showing noise measurement results in the case of the sleeve antenna system.
Figure 23A:
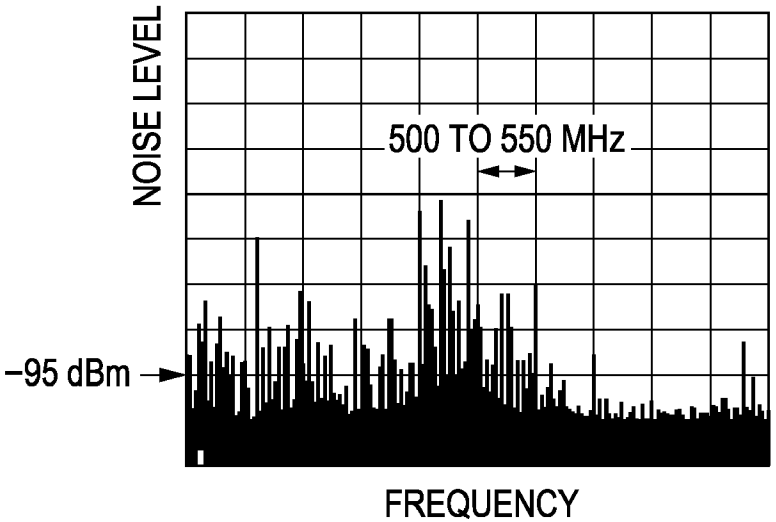

FIGS. 23A and 23B are diagram showing noise measurement results in the case of the sleeve antenna system. FIG. 23A shows noise measurement results at the time of power-off, and FIG. 23B shows noise measurement results at the time of power-on.

From FIGS. 23A and 23B, it can be found that by adopting a sleeve antenna 230, compared to an ordinary rod antenna, a noise is improved by 7 dB.

As already described in the section of a background art, in the case of the sleeve antenna, the antenna has a structure in which a signal is transmitted by a coaxial cable and an antenna is disposed at the leading end of the coaxial cable. Especially noteworthy is a folded structure of a ground GND, which is called a sleeve.

This blocks an electric current, which is carried by an outer covering of a cable, by increasing impedance in terms of high-frequency by the folded structure of the sleeve. This sleeve structure complicates a mechanism, thereby causing increase in cost.

Figure 24A:
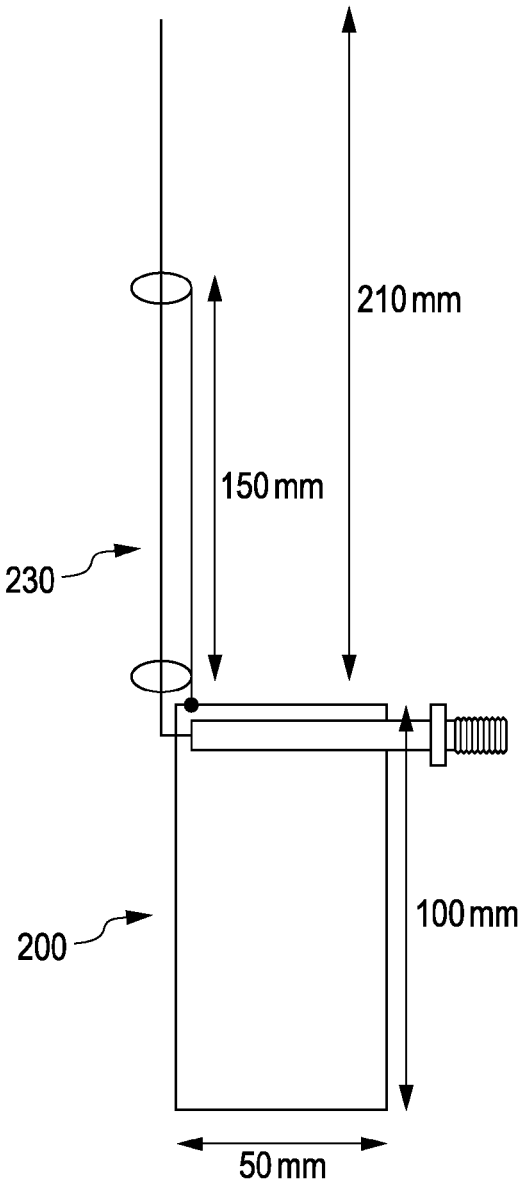
FIGS. 24A and 24B are diagrams showing a mobile telephone in which a sleeve antenna having no folding back applied.
Figure 24B:
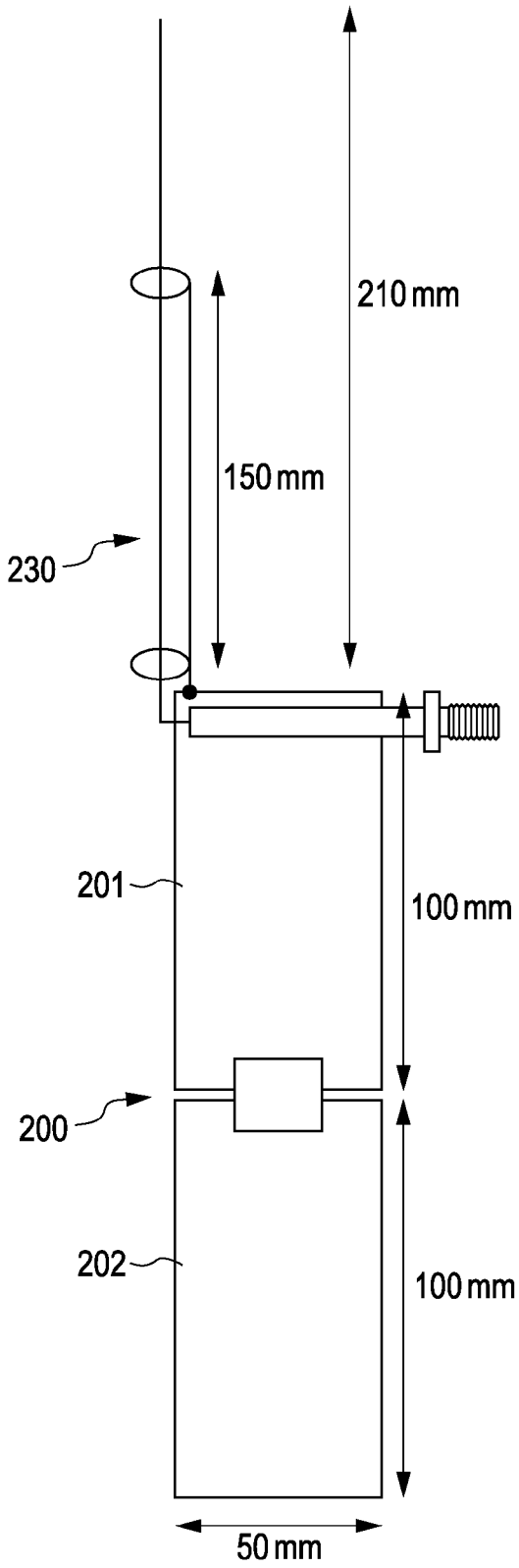

FIGS. 24A and 24B are diagrams showing a mobile telephone in which a sleeve antenna having no folding back applied. FIG. 24A shows a case where the main body of the mobile telephone is closed, and FIG. 24B shows a case where the main body of the mobile telephone is opened.

The mobile telephone 200 is configured so as to be able to open and close the first housing 201 and the second housing 202.

The example shown in FIGS. 24A and 24B is an example in which a 3-core coaxial sleeve antenna 230 of 150 mm having no folding back is used.

Figure 25A:
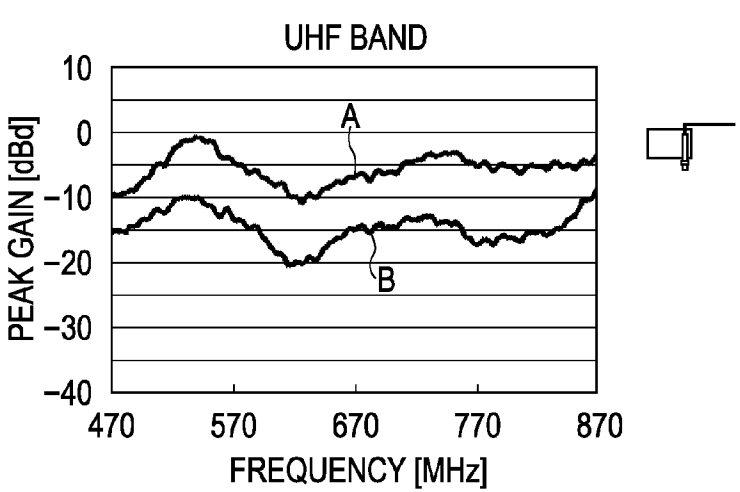
FIGS. 25A and 25B are diagrams showing the relationship between frequency and peak gain characteristics in a case where the mobile telephone in which the sleeve antenna having no folding back applied is closed.
Figure 25B:
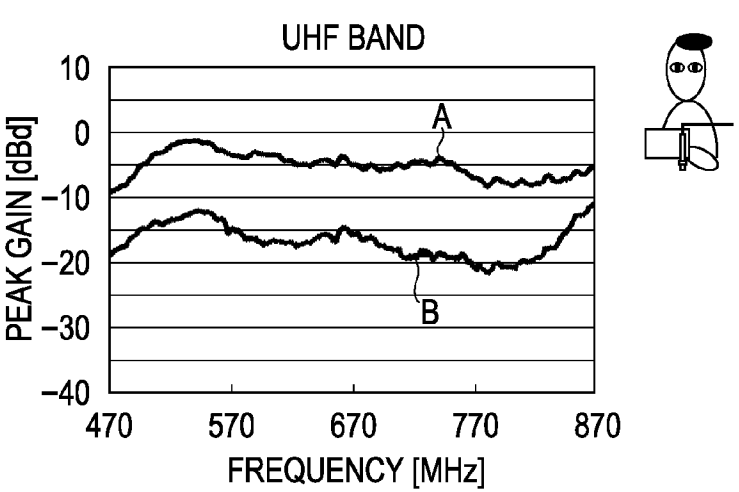

FIGS. 25A and 25B are diagrams showing the relationship between frequency and peak gain characteristics in a case where the mobile telephone in which the sleeve antenna having no folding back is applied is closed. FIG. 25A shows the characteristics in a free space, and FIG. 25B shows the characteristics in a case where the mobile telephone is mounted on a human body.

Figure 26A:
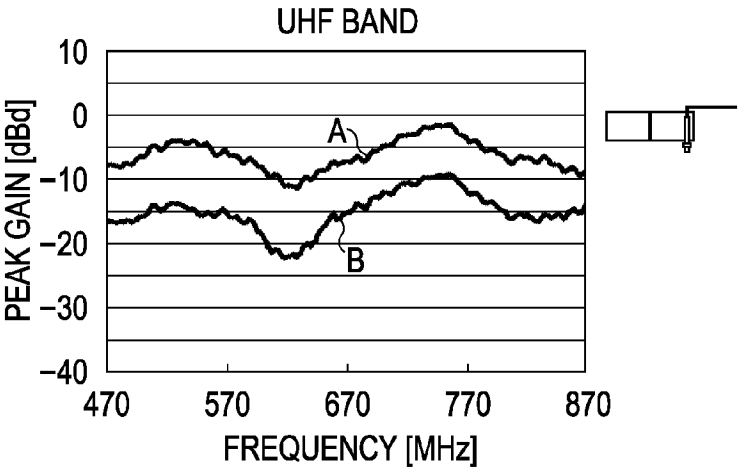
FIGS. 26A and 26B are diagrams showing the relationship between frequency and peak gain characteristics in a case where the mobile telephone in which the sleeve antenna having no folding back applied is opened.
Figure 26B:
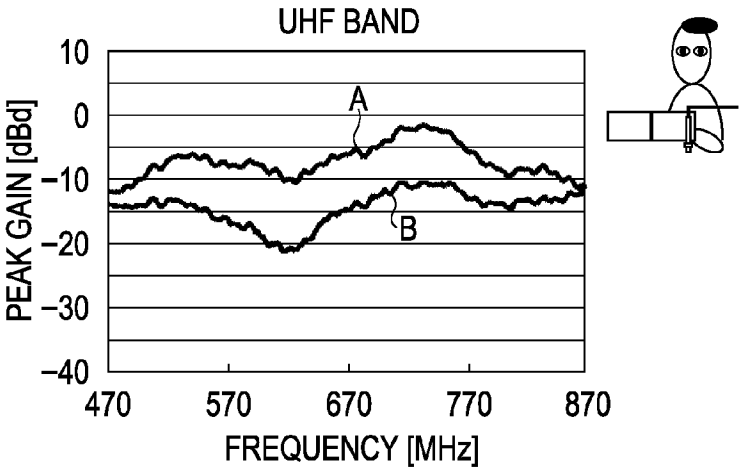

FIGS. 26A and 26B are diagrams showing the relationship between frequency and peak gain characteristics in a case where the mobile telephone in which the sleeve antenna having no folding back is applied is opened. FIG. 26A shows the characteristics in a free space, and FIG. 26B shows the characteristics in a case where the mobile telephone is mounted on a human body.

In FIGS. 25A, 25B, 26A, and 26B, a curved line indicated by "A" shows the characteristic of horizontal polarization, and a curved line indicated by "B" shows the characteristic of vertical polarization.

This example shows a structure in which the antenna is drawn by the coaxial cable, thereby being kept away from the set, and is an example in which the antenna is fitted to a state which is optimum in a UHF band.

In the case of the sleeve antenna 230, since there is no folded structure, resonance is performed by making the set ground GND and the ground GND of the coaxial cable to function as the ground GND of the antenna.

Therefore, the problem is that resonance frequency varies in accordance with the length of the connected set ground GND. Also, since the set ground GND also contributes to the radiation of the antenna, in a case such as mobile communication which is used with held by a human body, since the set ground GND is grasped, there is a problem in that the gain of the antenna is affected.

In order to reduce the influence of the cable and the set ground GND while reducing a noise from the set, it is necessary to provide a folded ground GND.

Although various folded structures can be given, all the structures are large in size, complicated, and very difficult to be realized at a low price and stylish.

This is related to the function of the sleeve.

When configuring the sleeve antenna, it is necessary to put a certain distance between the coaxial wire and the sleeve portion.

This is because in a signal transmission path, characteristic impedance is related to a signal transmission distance.

Figure 27A:
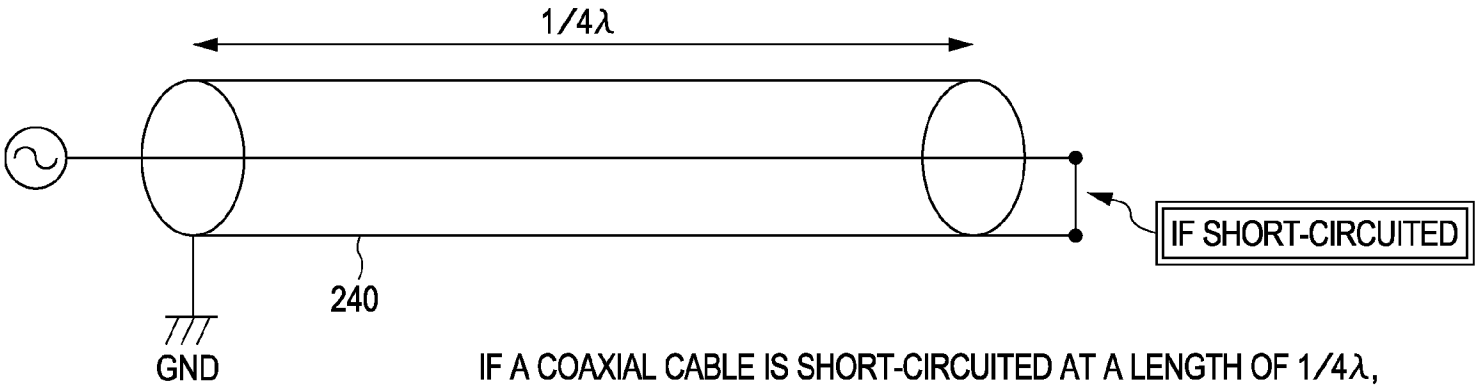
FIGS. 27A and 27B are diagrams illustrating a function in a case where the leading end of a transmission line is short-circuited.
Figure 27B:
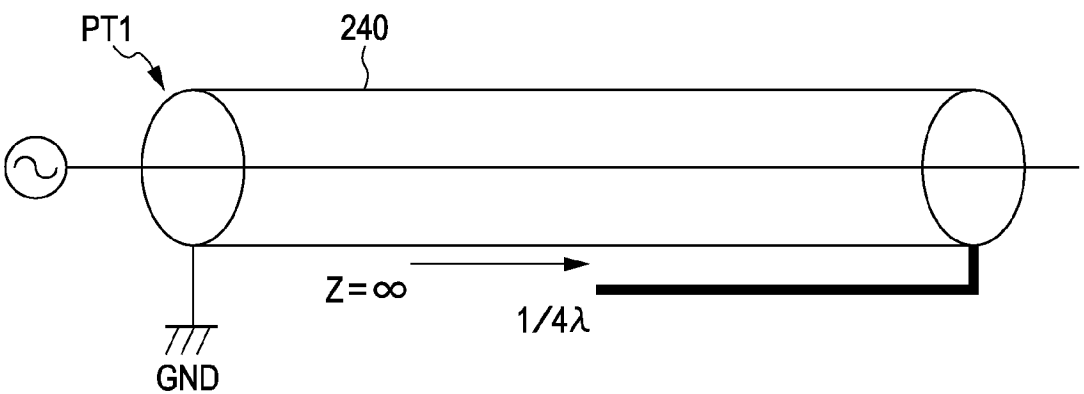

Also, this is because, as shown in FIGS. 27A and 27B, in a case where the leading end of a transmission line 240 is short-circuited, impedance becomes infinity ∞ at ¼λ of a transmission distance from a port PT1, so that it functions as a trap which blocks an electric current. However, in the case of constituting the folded portion in a state where isolation is not sufficiently taken in terms of high-frequency, it means that no function is performed.

Figure 28:
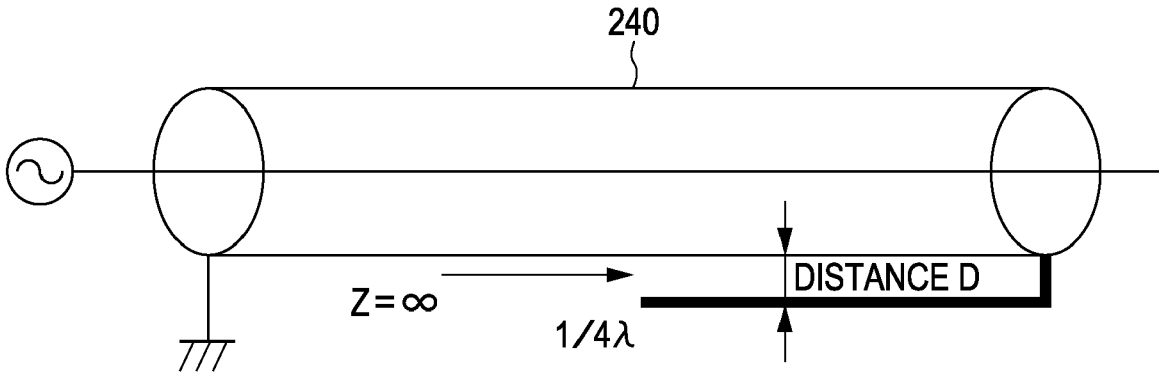
FIG. 28 is a diagram illustrating a trouble in a case where a sleeve portion is close to a coaxial transmission cable.

As shown in FIG. 28, in a case where the sleeve portion is close to the coaxial transmission cable, coupling occurs in terms of high-frequency, so that the portion does not function as a folded structure.

Figure 29A:
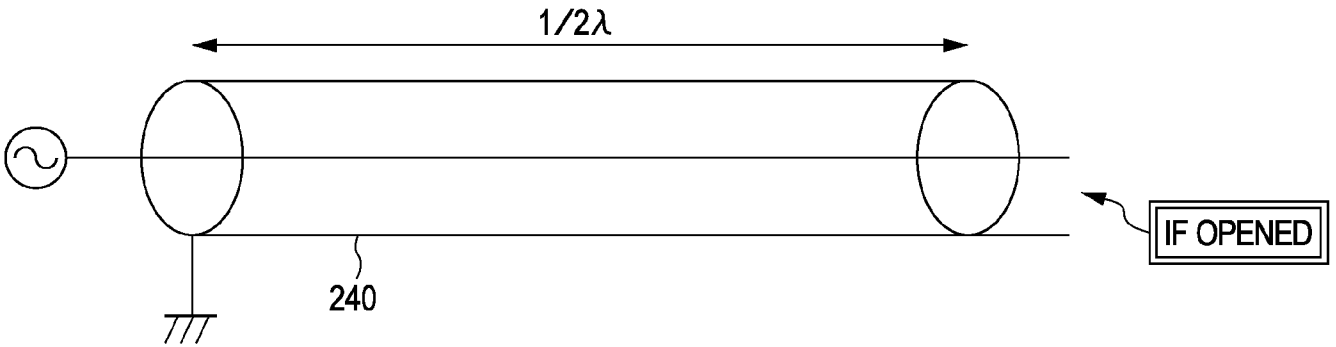
FIGS. 29A and 29B are diagrams illustrating a trouble in a case where, when a folded structure is formed by an electric wire, a folded cable is not spaced with a sufficient distance.
Figure 29B:
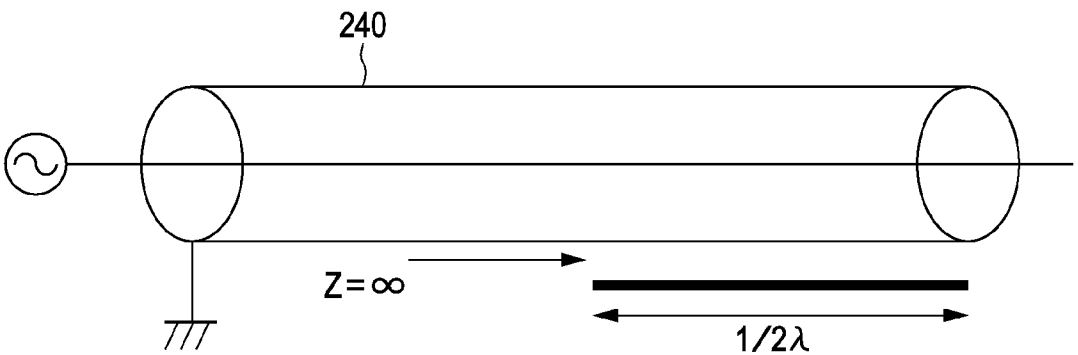

Therefore, in a case where a folded structure as shown in FIGS. 29A and 29B is formed by an electric wire, when a sufficient distance is not put in a folded cable, it is considered that coupling to a transmission line occurs, so that sufficient function is not performed.

Therefore, in this embodiment, as shown in FIGS. 1A, 1B, 10A, 10B, and 13A to 16C, by using the shield cables 10, 10A, 10B, and 10C having a double shield structure, these problems are solved.

First, in the antenna devices 30, 30A, and 30B, in a case where transmission of a signal is performed by a coaxial cable, by making the inner conductor 11 and the first outer conductor (braided shield 1) 13 function as a coaxial cable, signal transmission is performed.

Next, the shield cables 10, 10A, 10B, and 10C of this embodiment have a structure in which a folded structure is provided by using the second outer conductor (braided shield 2) 15.

In the case of a sleeve antenna having a folded structure previously proposed, when constructing a folded portion, there is an example in which the folded portion is constructed by using a sheet metal, or a case where the folded portion is constructed by performing a terminal treatment on a shield portion of an ordinary high-frequency coaxial cable called 5C-2V, and folding back the portion.

However, there were problems with all the structures or designs.

On the contrary, by using the shield cables 10, 10A, 10B, and 10C according to this embodiment, the folded structure can be easily realized.

Also, there is a cable having a double shield including a first ply made by a braid or a served shield and a second ply made of an electrically-conductive seal such as an aluminum foil. However, even if this is used in the folded structure, the double shield is coupled in terms of high-frequency, so that the folded structure is not obtained.

On the contrary, by making a coaxial structure be double, as in the shield cables 10, 10A, 10B, and 10C according to this embodiment, a structure using high-frequency characteristic of a coaxial cable can be obtained for the first time.

This is because a folded structure of a sleeve utilizes a characteristic in which in a case where the leading end of a coaxial cable is short-circuited, impedance becomes infinity at a length of (¼)λ.

This means that by making the first outer conductor (braided shield 1) 13 and the second outer conductor (braided shield 2) 15 be a coaxial structure with the consideration of impedance, a characteristic depending on a wavelength in the transmission path can be realized.

Figure 30A:
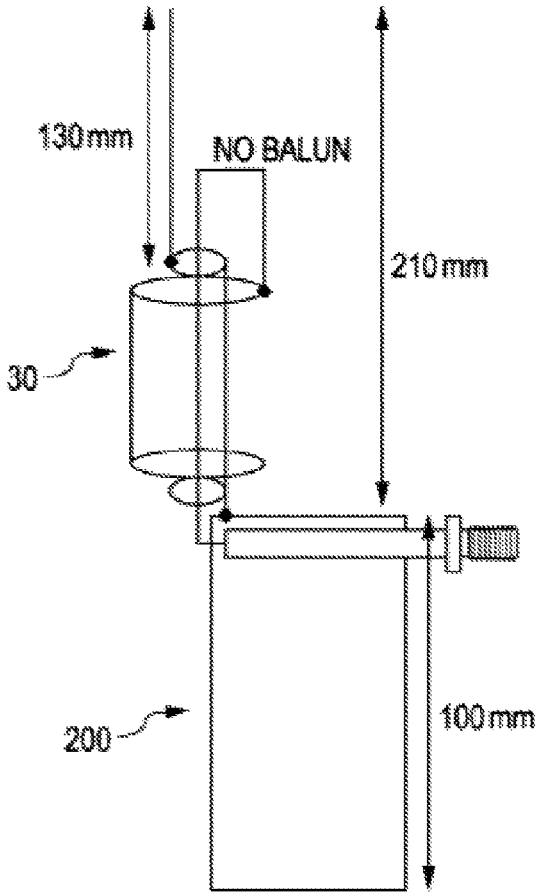
FIGS. 30A and 30B are diagrams showing a mobile telephone in which the antenna device according to the third embodiment having no balun applied.
Figure 30B:
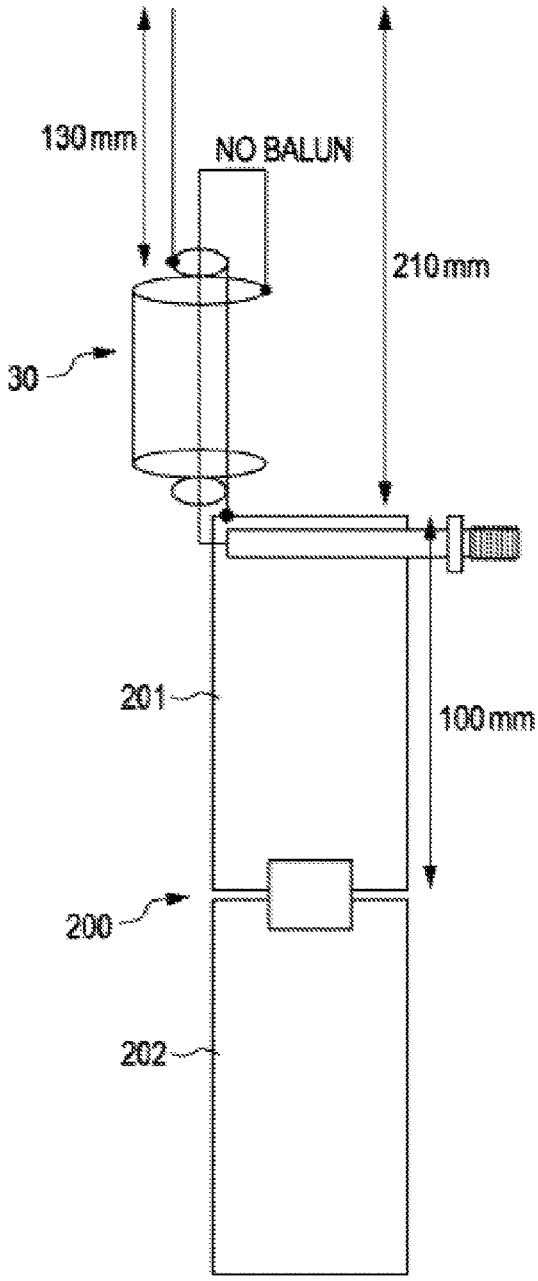

FIGS. 30A and 30B are diagrams showing a mobile telephone in which the antenna device according to the third embodiment having no balun applied. FIG. 30A shows a case where the main body of the mobile telephone is closed, and FIG. 30B shows a case where the main body of the mobile telephone is opened.

The mobile telephone 200 is configured so as to be able to open and close a first housing 201 and a second housing 202.

The example shown in FIGS. 30A and 30B is an example in which the antenna device 30 of 210 mm having no balun is used.

Figure 31A:
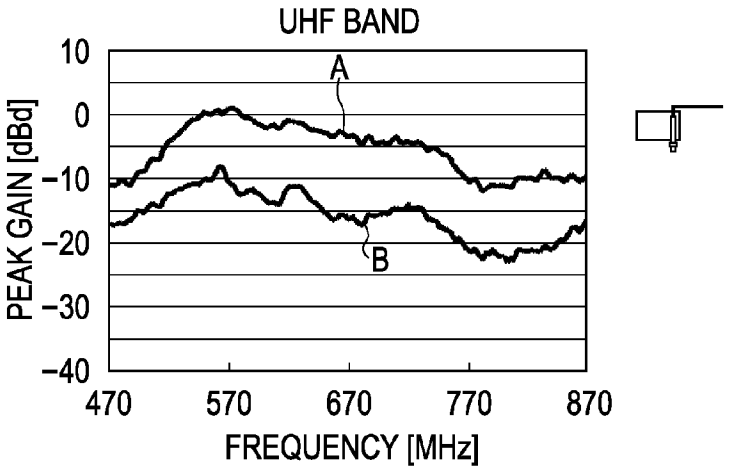
FIGS. 31A and 31B are diagrams showing the relationship between frequency and peak gain characteristics in a case where the mobile telephone in which the antenna device according to the third embodiment having no balun applied is closed.
Figure 31B:
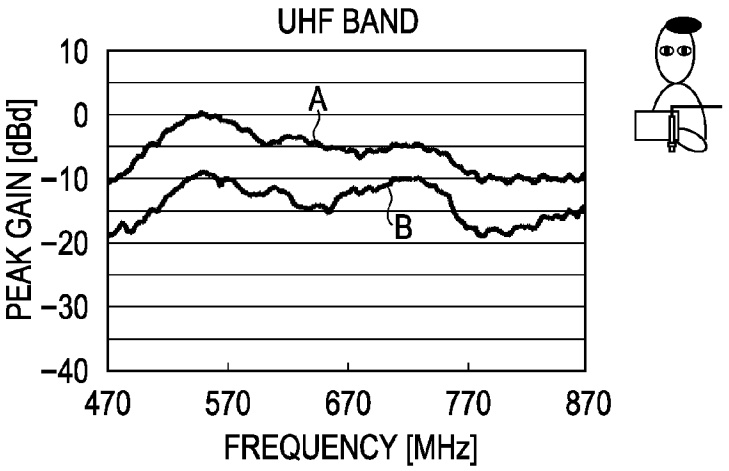

FIGS. 31A and 31B are diagrams showing the relationship between frequency and peak gain characteristics in a case where the mobile telephone in which the antenna device according to the third embodiment having no balun applied is closed. FIG. 31A shows the characteristics in a free space, and FIG. 31B shows the characteristics in a case where the mobile telephone is mounted on a human body.

Figure 32A:
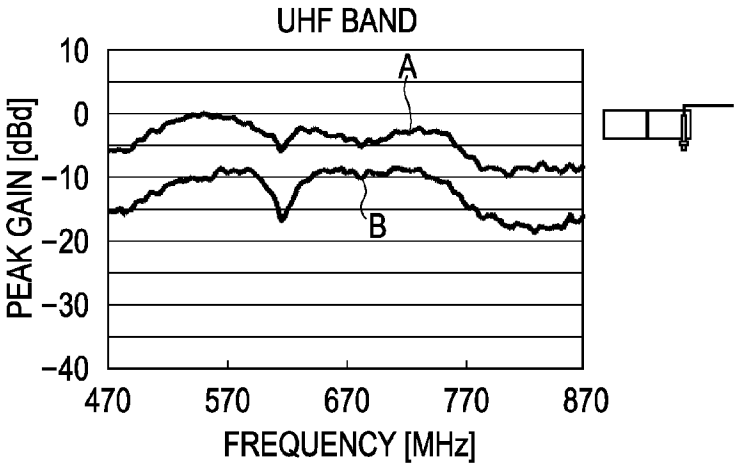
FIGS. 32A and 32B are diagrams showing the relationship between frequency and peak gain characteristics in a case where the mobile telephone in which the antenna device according to the third embodiment having no balun applied is opened.
Figure 32B:
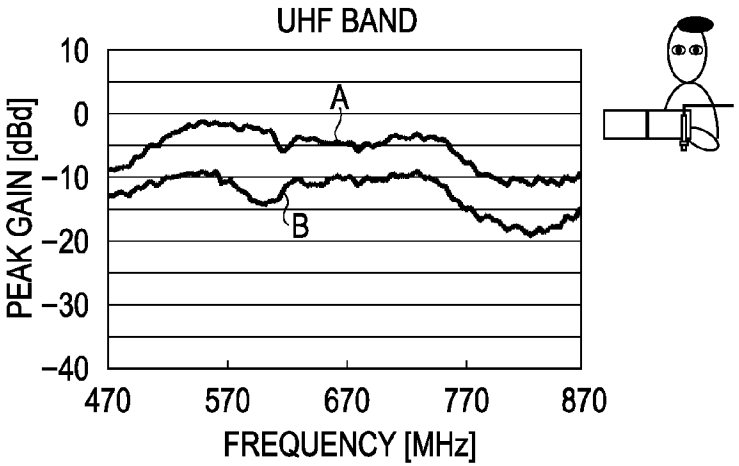

FIGS. 32A and 32B are diagrams showing the relationship between frequency and peak gain characteristics in a case where the mobile telephone in which the antenna device according to the third embodiment having no balun applied is opened. FIG. 32A shows the characteristics in a free space, and FIG. 32B shows the characteristics in a case where the mobile telephone is mounted on a human body.

In FIGS. 31A, 31B, 32A, and 32B, a curved line indicated by "A" shows the characteristic of horizontal polarization, and a curved line indicated by "B" shows the characteristic of vertical polarization.

In the antenna device 30 according to the third embodiment having no balun, null is partly generated by the ground GND of the set. However, as shown in FIGS. 31A, 31B, 32A, and 32B, it can be found that a gain near 520 MHz which functions as a sleeve is little affected.

Figure 33A:
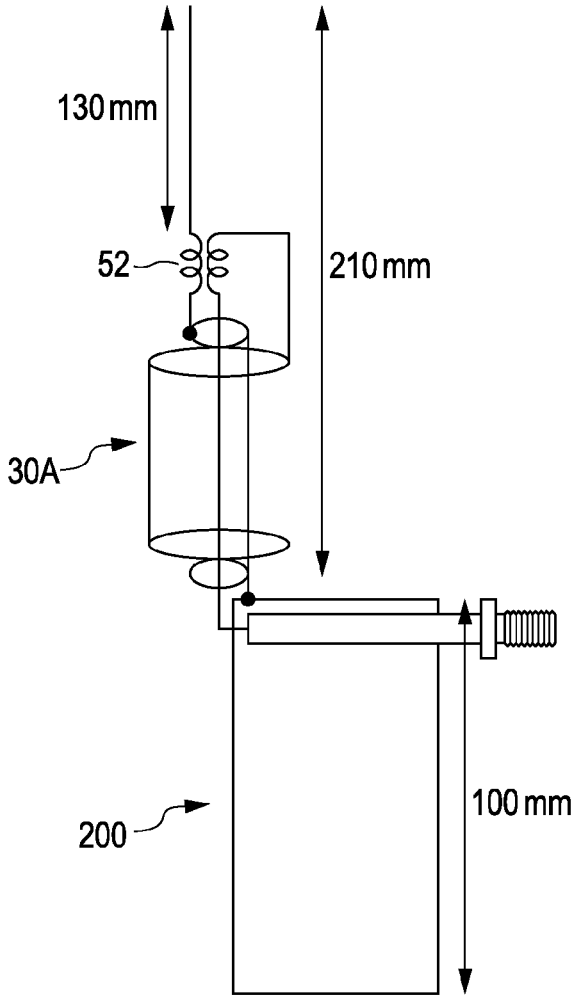
FIGS. 33A and 33B are diagrams showing a mobile telephone in which the antenna device according to the fourth embodiment having a balun applied.
Figure 33B:
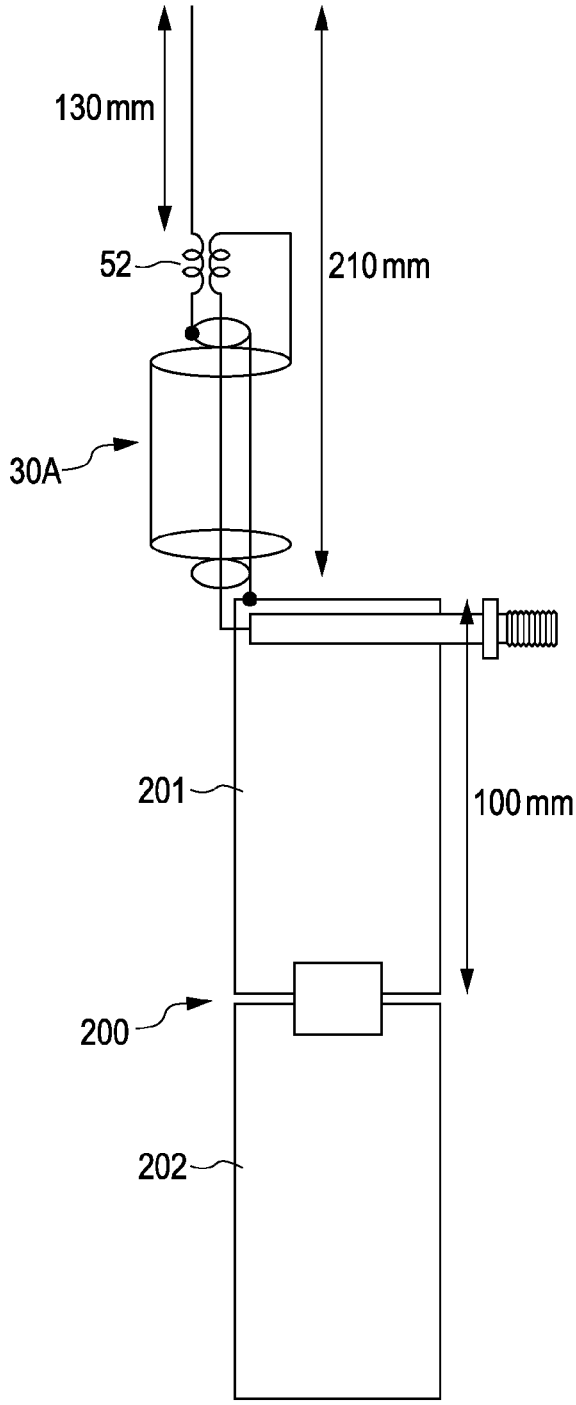

FIGS. 33A and 33B are diagrams showing a mobile telephone in which the antenna device according to the fourth embodiment having a balun applied. FIG. 33A shows a case where the main body of the mobile telephone is closed, and FIG. 33B shows a case where the main body of the mobile telephone is opened.

The mobile telephone 200 is configured so as to be able to open and close a first housing 201 and a second housing 202.

The example shown in FIGS. 33A and 33B is an example in which the antenna device 30A of 210 mm having a balun is used.

Figure 34A:
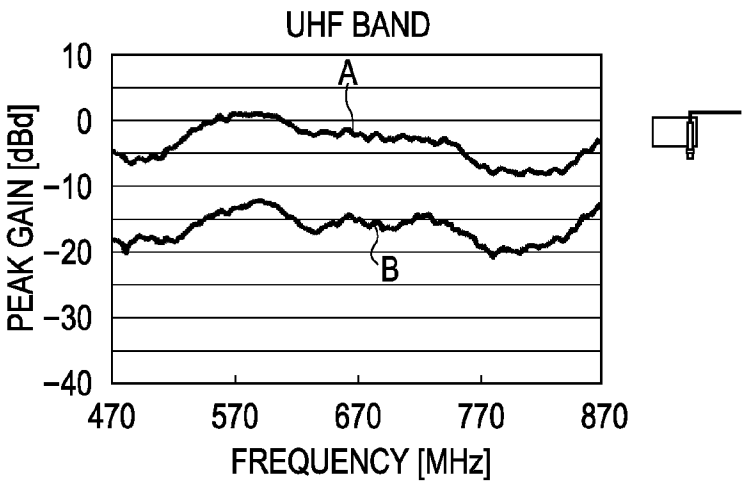
FIGS. 34A and 34B are diagrams showing the relationship between frequency and peak gain characteristics in a case where the mobile telephone in which the antenna device according to the fourth embodiment having a balun applied is closed.
Figure 34B:
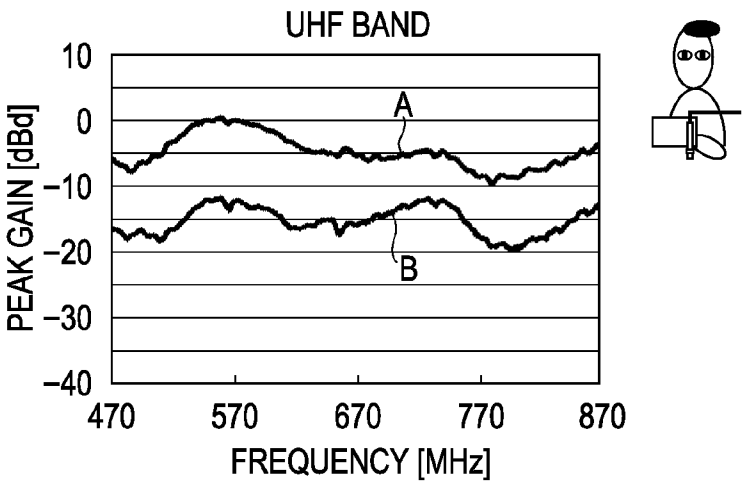

FIGS. 34A and 34B are diagrams showing the relationship between frequency and peak gain characteristics in a case where the mobile telephone in which the antenna device according to the fourth embodiment having a balun applied is closed. FIG. 34A shows the characteristics in a free space, and FIG. 34B shows the characteristics in a case where the mobile telephone is mounted on a human body.

Figure 35A:
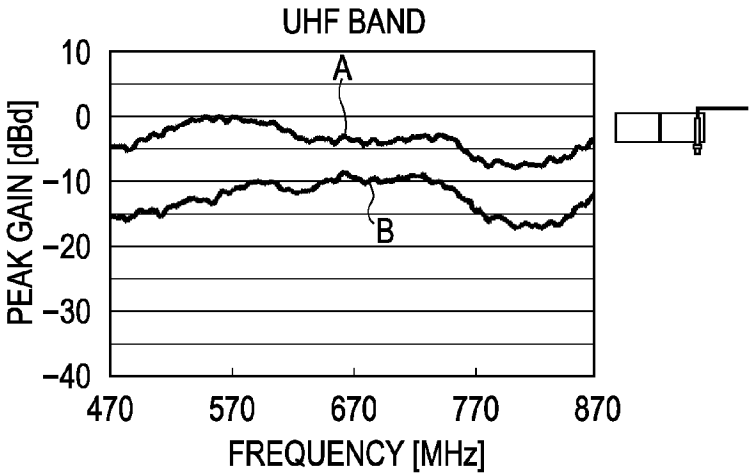
FIGS. 35A and 35B are diagrams showing the relationship between frequency and peak gain characteristics in a case where the mobile telephone in which the antenna device according to the fourth embodiment having a balun applied is opened.
Figure 35B:
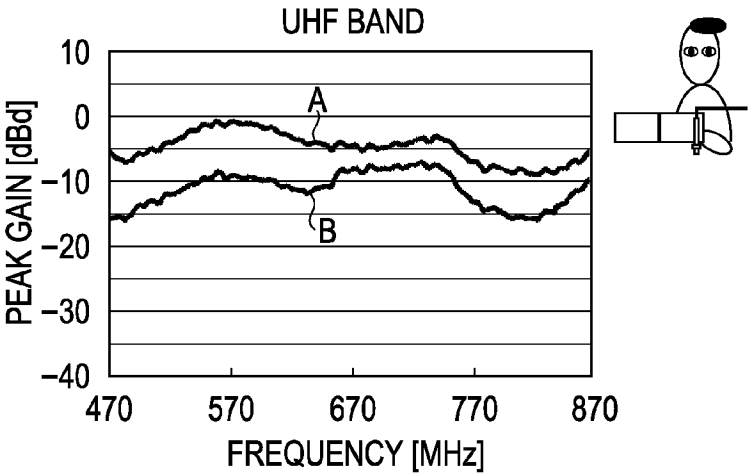

FIGS. 35A and 35B are diagrams showing the relationship between frequency and peak gain characteristics in a case where the mobile telephone in which the antenna device according to the fourth embodiment having a balun applied is opened. FIG. 35A shows the characteristics in a free space, and FIG. 35B shows the characteristics in a case where the mobile telephone is mounted on a human body.

In FIGS. 34A, 34B, 35A, and 35B, a curved line indicated by "A" shows the characteristic of horizontal polarization, and a curved line indicated by "B" shows the characteristic of vertical polarization.

In the antenna device 30A according to the fourth embodiment, a sleeve antenna is realized by connecting the inner conductor 11 to the second outer conductor (braided shield 2) 15 of the cable through the balun 52.

By this structure, as shown in FIGS. 34A, 34B, 35A, and 35B, an antenna which is not dependent on the ground GND of the set and in which influence at the time of equipping on a human body is reduced can be realized.

That is, the antenna device 30A according to the fourth embodiment uses the balun while using a double shield, so that an antenna which is not further affected by the set can be configured.

Figure 36:
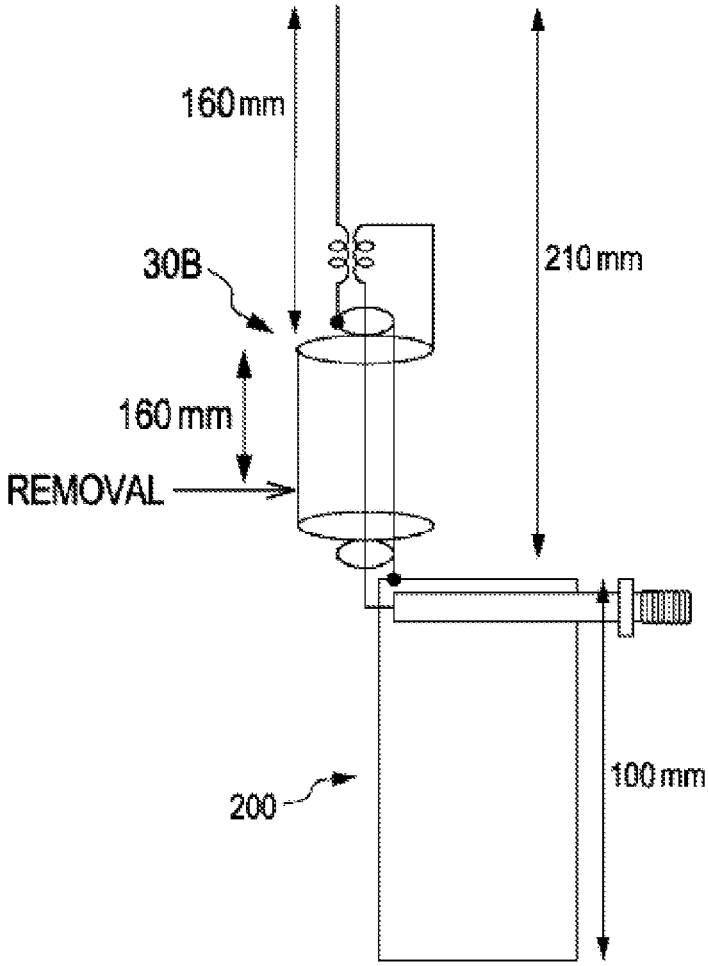
FIG. 36 is a diagram showing a mobile telephone in which the antenna device according to the fifth embodiment, in which a portion of the cable is removed, is applied.

FIG. 36 is a diagram showing a mobile telephone in which the antenna device according to the fifth embodiment, in which a portion of the cable is removed, is applied. FIG. 36 shows a case where the main body of the mobile telephone is closed.

The example shown in FIG. 36 is an example in which the antenna device 30B of 210 mm having a balun is used.

Figure 37:
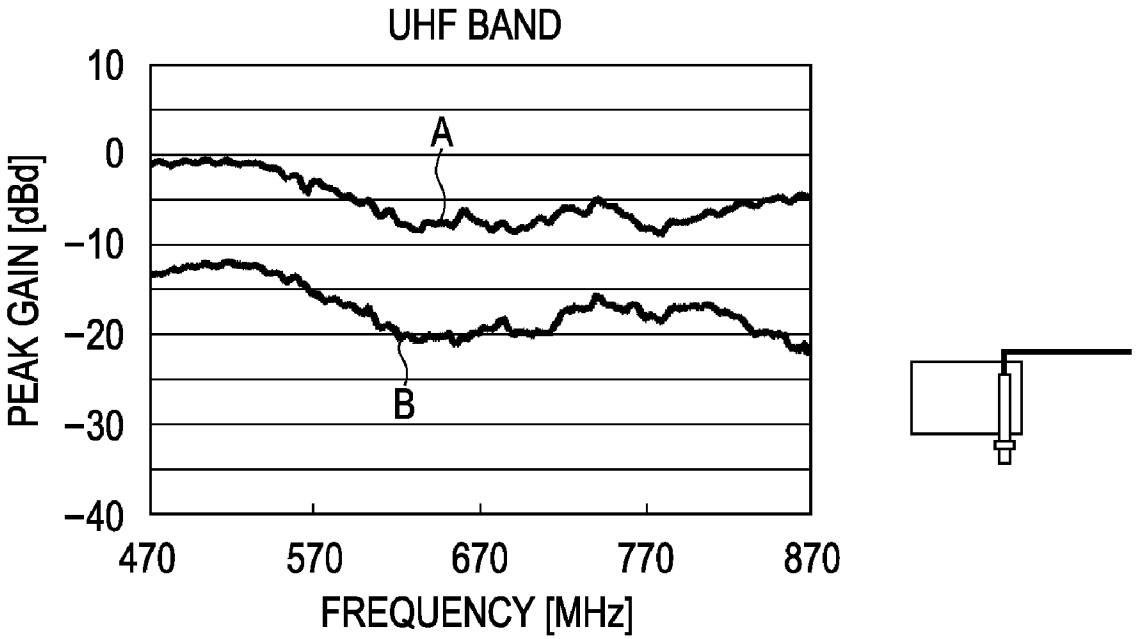
FIG. 37 is a diagram showing the relationship between frequency and peak gain characteristics in a case where the mobile telephone in which the antenna device according to the fifth embodiment, in which a portion of the cable is removed, is applied is closed.

FIG. 37 is a diagram showing the relationship between frequency and peak gain characteristics in a case where the mobile telephone in which the antenna device according to the fifth embodiment, in which a portion of the cable is removed, is applied is closed. FIG. 37 shows the characteristics in a free space.

In FIG. 37, a curved line indicated by "A" shows the characteristic of horizontal polarization, and a curved line indicated by "B" shows the characteristic of vertical polarization.

In the antenna device 30B according to the fifth embodiment, even in a case where the cable is long, the resonance frequency can be adjusted only by cutting the insulation sheath 16 and the second outer conductor 15 of the double shield, so that a linear dipole antenna can be configured.

As shown in FIG. 37, it can be found that the frequency of the antenna can be adjusted by cutting the insulation sheath 16 and the second outer conductor 15 at a place of 160 mm from the other end.

[Consideration of Characteristics According to the Presence or Absence of a Balun]

Next, characteristics according to the presence or absence of a balun are considered in connection with an antenna of a dipole system.

Figure 38:
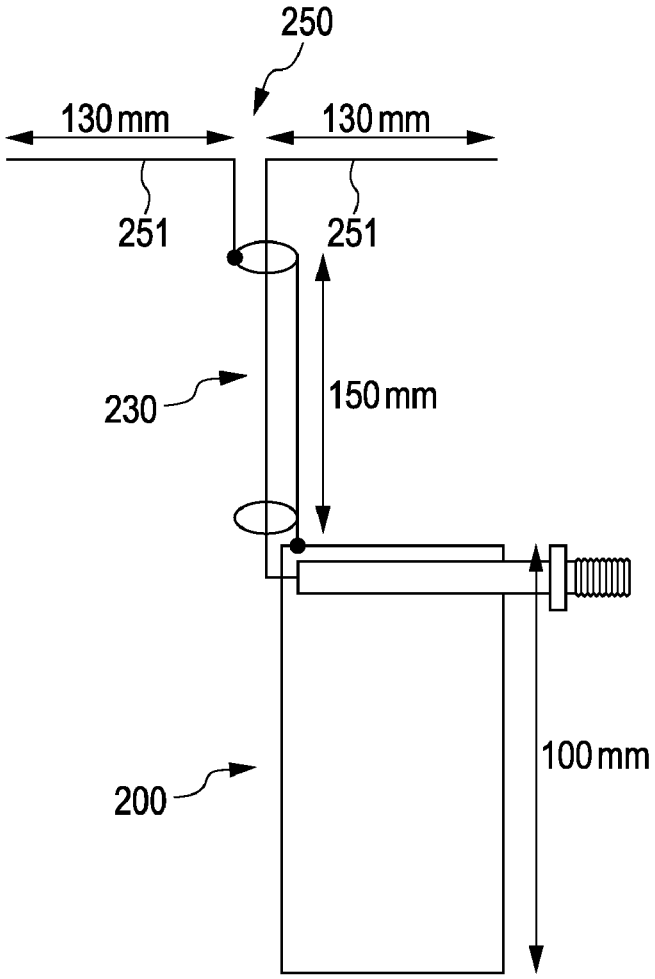
FIG. 38 is a diagram showing an example in which a dipole antenna device is configured as a 3-core coaxial structure without using a balun.

FIG. 38 is a diagram showing an example in which a dipole antenna device is configured as a 3-core coaxial structure without using a balun.

Figure 39:
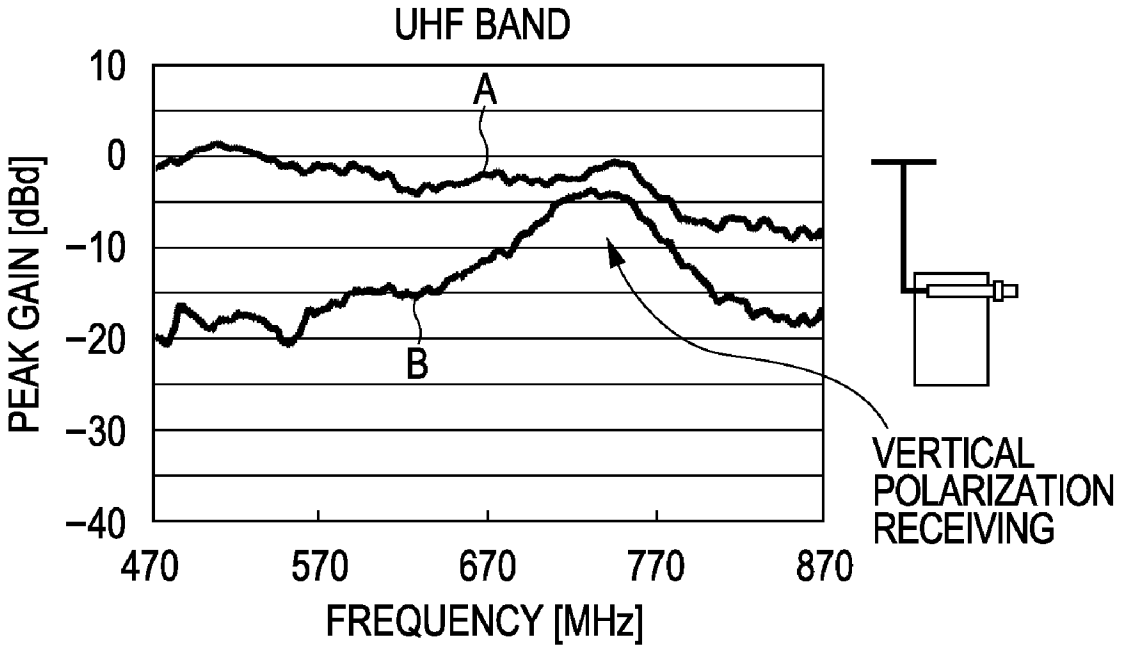
FIG. 39 is a diagram showing the relationship between frequency and peak gain characteristics in a case where the mobile telephone in which the antenna device of FIG. 38 is applied is closed.

FIG. 39 is a diagram showing the relationship between frequency and peak gain characteristics in a case where the mobile telephone in which the antenna device of FIG. 38 is applied is closed. FIG. 39 shows the characteristics in a free space.

In FIG. 39, a curved line indicated by "A" shows the characteristic of horizontal polarization, and a curved line indicated by "B" shows the characteristic of vertical polarization.

As shown in FIG. 38, an example is shown in which a dipole antenna element 250 is horizontally disposed, whereas the mobile telephone 200 which is a set main body is vertically disposed.

In this case, as shown in FIG. 39, although a polarized wave which can be received only by the dipole antenna is only a horizontally-polarized wave, a vertically-polarized wave is also partly received (refer to the vicinity of MHz).

This represents that radio waves carried by the coaxial cable are received.

Therefore, this means that in a case where a balun is not provided, due to the influence of the length of the cable and the size of the set, in a portion of frequencies, characteristics are improved, and in another portion of frequencies, reversely, there is a fear that a cancel gain will be attenuated.

Figure 40:
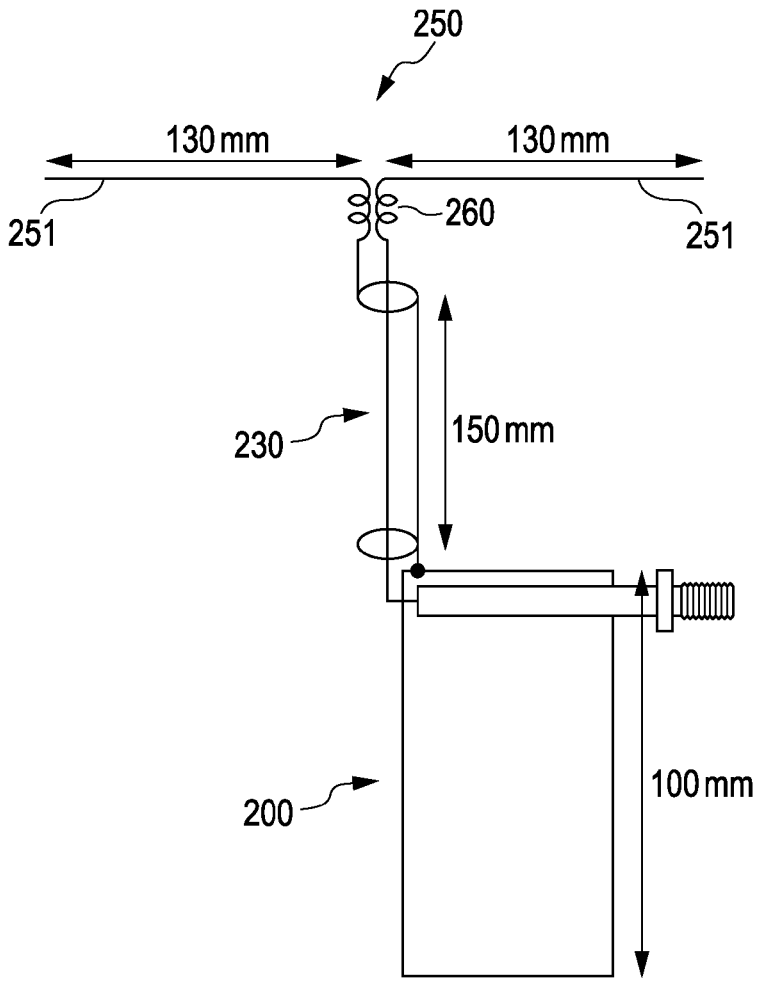
FIG. 40 is a diagram showing an example in which a dipole antenna device is configured as a 3-core coaxial structure by using a balun.

FIG. 40 is a diagram showing an example in which a dipole antenna device is configured as a 3-core coaxial structure by using a balun.

Figure 41:
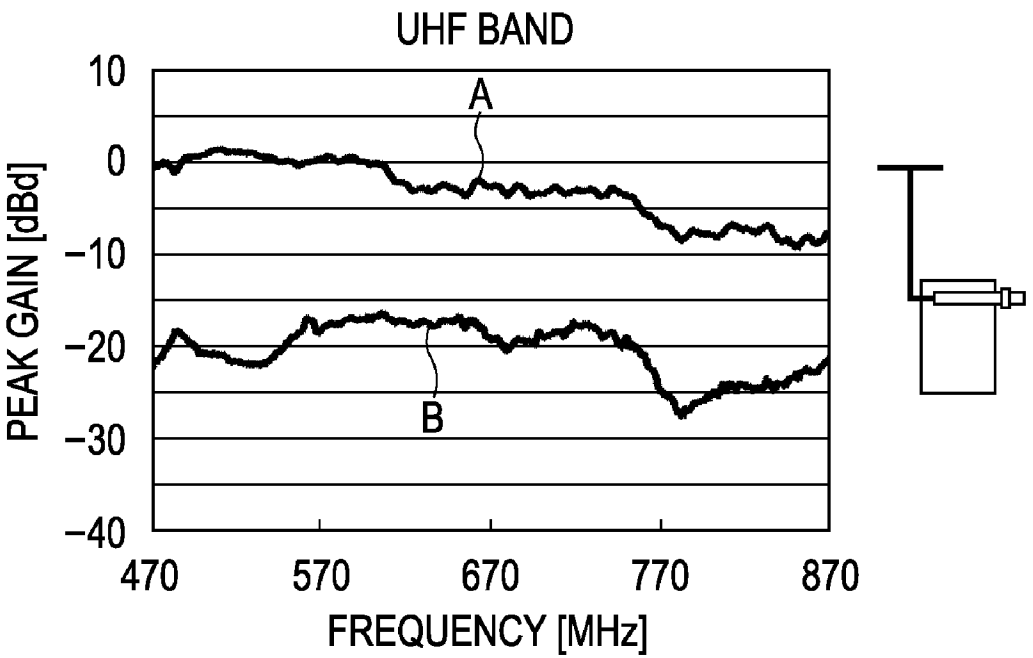
FIG. 41 is a diagram showing the relationship between frequency and peak gain characteristics in a case where the mobile telephone in which the antenna device of FIG. 40 is applied is closed.

FIG. 41 is a diagram showing the relationship between frequency and peak gain characteristics in a case where the mobile telephone in which the antenna device of FIG. 40 is applied is closed. FIG. 41 shows the characteristics in a free space.

In FIG. 41, a curved line indicated by "A" shows the characteristic of horizontal polarization, and a curved line indicated by "B" shows the characteristic of vertical polarization.

In FIG. 40, the antenna is configured by preparing two elements (130 mm) of ¼λ of a frequency of 500 MHz so as to perform resonance at a UHF frequency band of 470 MHz to 770 MHz, and performing balance-unbalance conversion by a balun 260.

An antenna can be ideally realized which does not receive a vertically-polarized wave, is very broad in band, and has excellent gain.

Also, since the antenna is drawn from the set by the coaxial cable, it can be said that the antenna is an antenna which does not receive a noise of the device and is excellent with respect to a noise.

Therefore, the use of the balun 260 is necessary to construct an antenna which is not dependent on a cable.

Figure 42:
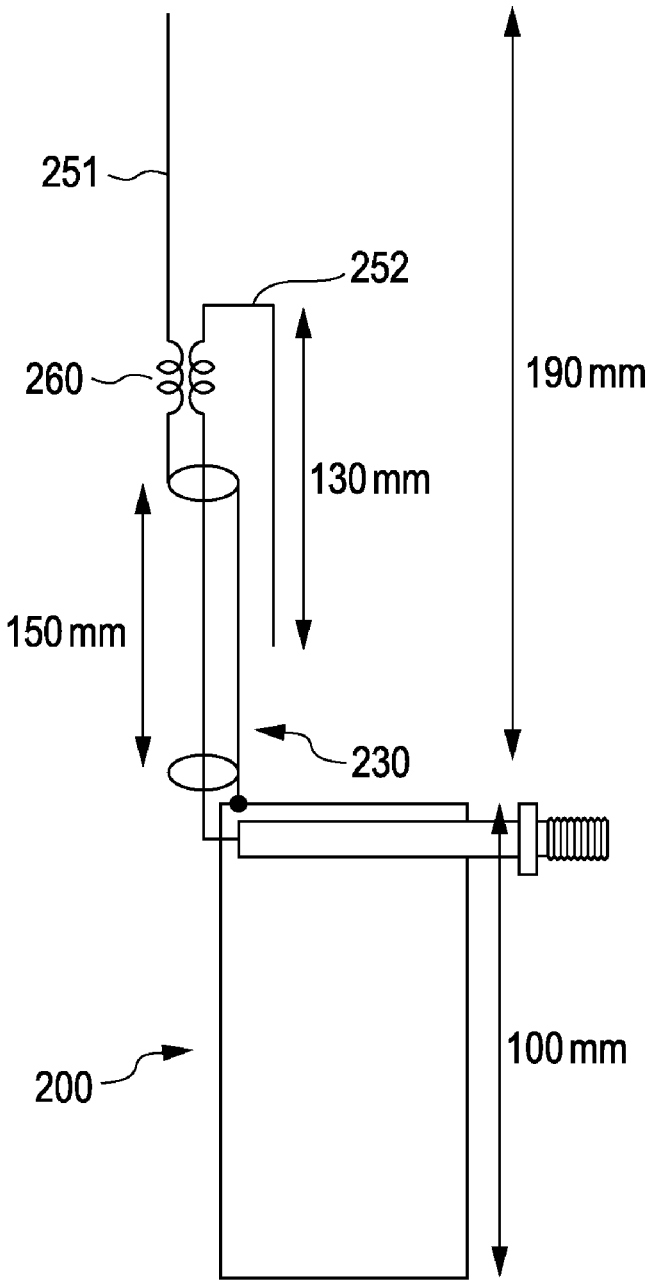
FIG. 42 is a diagram showing a modified example of the antenna device of FIG. 40.

FIG. 42 is a diagram showing a modified example of the antenna device of FIG. 40.

Figure 43:
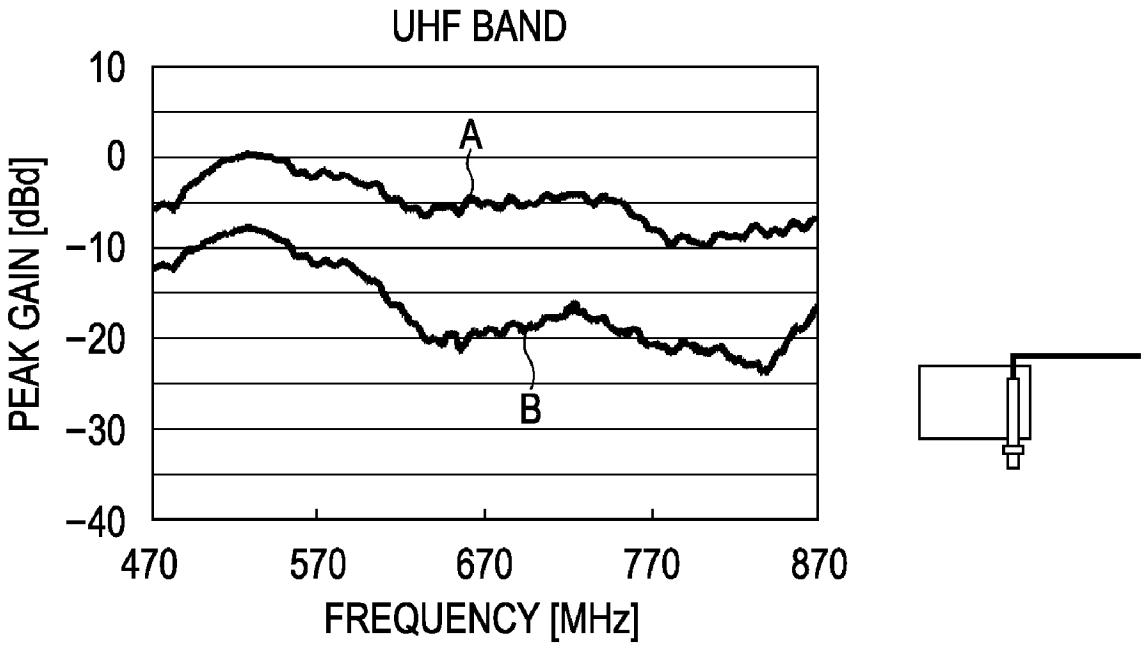
FIG. 43 is a diagram showing the relationship between frequency and peak gain characteristics in a case where the mobile telephone in which the antenna device of FIG. 42 is applied is closed.

FIG. 43 is a diagram showing the relationship between frequency and peak gain characteristics in a case where the mobile telephone in which the antenna device of FIG. 42 is applied is closed. FIG. 43 shows the characteristics in a free space.

In FIG. 43, a curved line indicated by "A" shows the characteristic of horizontal polarization, and a curved line indicated by "B" shows the characteristic of vertical polarization.

The antenna device of FIG. 42 is an example in which an element 252 of the antenna is folded to extend along the cable. The element 252 is disposed parallel to, but being spaced a distance of about 1 cm from a coaxial cable 230.

Also in this case, the antenna device is excellent in terms of gain and functions as a dipole.

[Consideration of Folded Structure]

Figure 44:
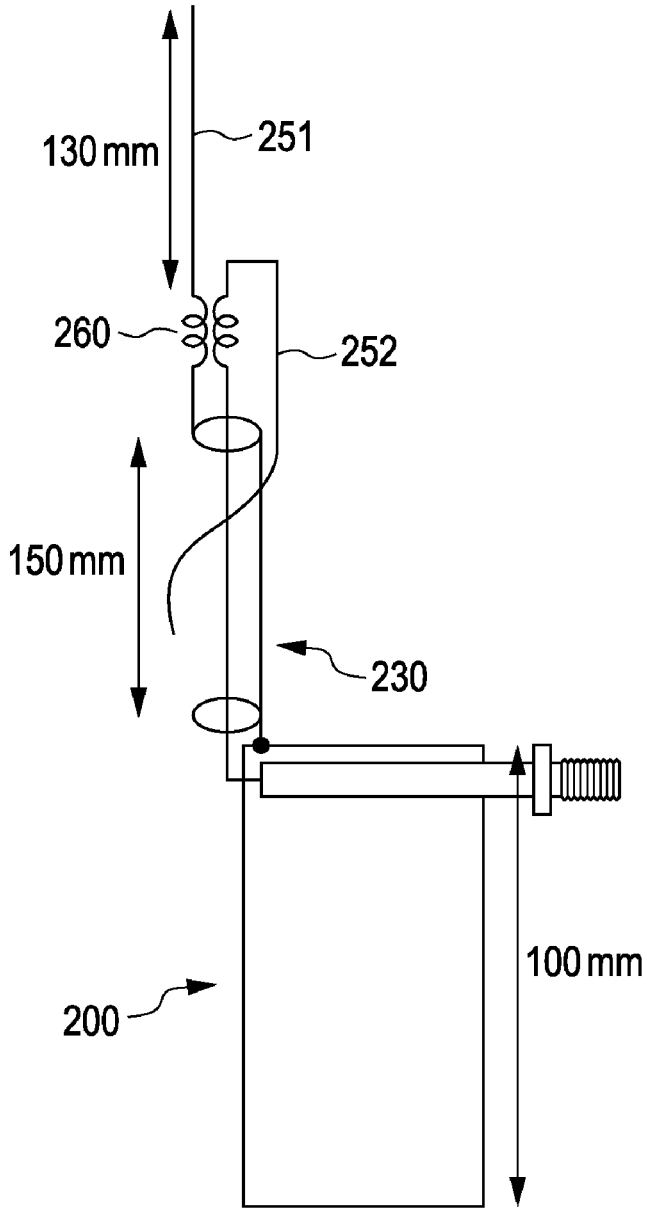
FIG. 44 is a diagram showing a modified example of the antenna device of FIG. 42.

FIG. 44 is a diagram showing a modified example of the antenna device of FIG. 42.

Figure 45:
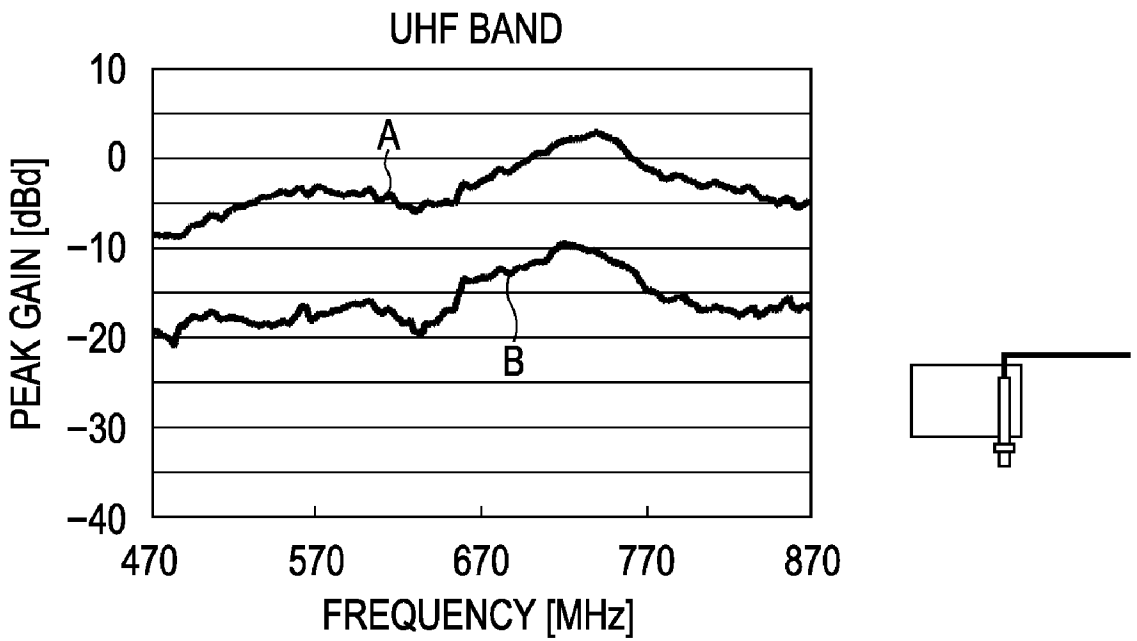
FIG. 45 is a diagram showing the relationship between frequency and peak gain characteristics in a case where the mobile telephone in which the antenna device of FIG. 44 is applied is closed.

FIG. 45 is a diagram showing the relationship between frequency and peak gain characteristics in a case where the mobile telephone in which the antenna device of FIG. 44 is applied is closed. FIG. 45 shows the characteristics in a free space.

In FIG. 45, a curved line indicated by "A" shows the characteristic of horizontal polarization, and a curved line indicated by "B" shows the characteristic of vertical polarization.

The antenna device of FIG. 44 is an example in which the element 252 is disposed closely to the coaxial cable 230 and is in an insulated state in terms of a direct current.

In this case, as shown in FIG. 45, it can be found that a characteristic obviously varies and a gain of 500 MHz band varies.

This is because that the length of the antenna element extends over the combined lengths of the coaxial cable 230 and a set substrate.

Figure 46:
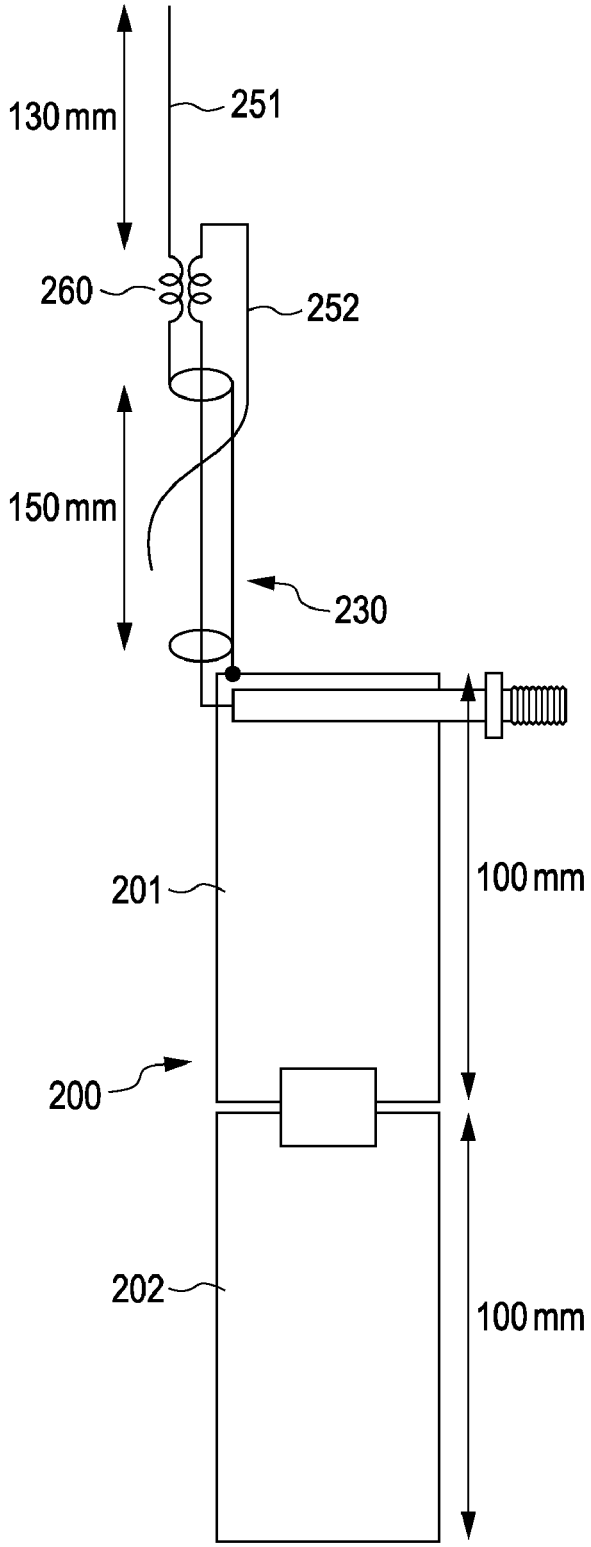
FIG. 46 is a diagram showing an example in which the length of a substrate is changed from the state of FIG. 44.

FIG. 46 is a diagram showing an example in which the length of the substrate is changed from a state of FIG. 44.

Figure 47:
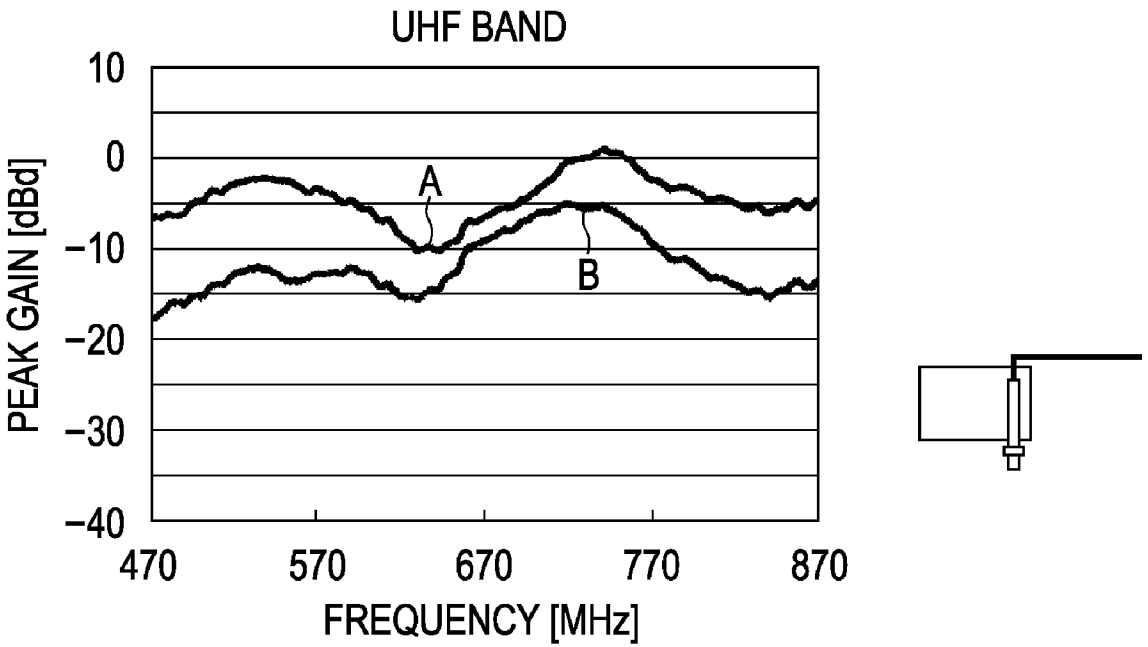
FIG. 47 is a diagram showing the relationship between frequency and peak gain characteristics in a case where the mobile telephone in which the antenna device of FIG. 46 is applied is closed.

FIG. 47 is a diagram showing the relationship between frequency and peak gain characteristics in a case where the mobile telephone in which the antenna device of FIG. 46 is applied is closed. FIG. 47 shows the characteristics in a free space.

In FIG. 47, a curved line indicated by "A" shows the characteristic of horizontal polarization, and a curved line indicated by "B" shows the characteristic of vertical polarization.

FIG. 46 is an example in which the length of the substrate is changed so as to be 200 mm×50 mm.

As shown in FIG. 47, it can be said that by the change of the length of the substrate, the gain of the antenna largely varies, and the substrate and a portion of the antenna are coupled, so that the characteristics of the antenna is changed.

That is, it can be said that if the cable is not kept away from the substrate sufficiently, it is difficult to maintain a characteristic.

On the contrary, the antenna device 30A with the balun according to the fourth embodiment is not dependent on the ground GND of the main body of the set (mobile telephone) and has an improved antenna gain, as previously explained in connection with FIGS. 33A to 35B.

Also, in the antenna device 30 having no balun according to the third embodiment, as previously explained in connection with FIGS. 30A to 32B, although there is a case where null is partly generated, even in the case of having no balun, there is no problem with respect to 500 MHz band in which a coaxial trap functions.

Therefore, in a case where the antenna device is configured by using the double shielded cable according to this embodiment, while the balun is not necessarily provided, excellent characteristics can be obtained. However, by using the balun, it is possible to configure an antenna which is not further affected by the set.

Also, as shown in FIGS. 13A to 16C, just with a terminal treatment of the cable, the sleeve portion can be configured, so that the sleeve portion can be configured without using a sheet metal, or a sleeve element as a separate component. As a result, the antenna device can be configured very simply and at a low price, and designed in accordance with only the thickness of the cable and a balun space.

Also, since it is not necessary to form the antenna into a T-shape like a dipole antenna, the configuration of the component also becomes simpler, and the antenna can be used as a linear antenna.

The present application contains subject matter related to that disclosed in Japanese Priority Patent Application JP 2009-069089 filed in the Japan Patent Office on Mar. 19, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A system comprising:

a shielded cable having an inner conductor, a first insulator, a first outer conductor, a second insulator, and a second outer conductor, which are coaxially disposed in this order from an inner side, and having an outer circumference coated by an insulation sheath;

a receiver connected to a first end of the shielded cable by a first connection portion, the first connection portion configured to connect a power supply of the receiver to the inner conductor, and connect a ground of the receiver to the first outer conductor; and an antenna element connected to a second end of the shielded cable by a second connection portion, the second connection portion configured to connect the antenna element to the first outer conductor, and connect the inner conductor to the second outer conductor, wherein at least a portion of the shielded cable functions as an antenna for receiving a high-frequency signal.

2. The system of claim 1, the second connection portion comprising a balance-unbalance converter, the antenna element being connected to the first outer conductor through the balance-unbalance converter, and the inner conductor being connected to the second outer conductor through the balance-unbalance converter.

3. The system of claim 2, wherein the shielded cable has a removed portion, the removed portion being a portion of the shielded cable in which the insulation sheath and the second outer conductor are not present, the shielded cable with the removed portion being configurable to adjust a frequency of the system.

4. A system comprising:

a shielded cable having an inner conductor, a first insulator, a first outer conductor, a second insulator, and a second outer conductor, which are coaxially disposed in this order from an inner side, and having an outer circumference coated by an insulation sheath;

a receiver connected to a first end of the shielded cable by a first connection portion, the first connection portion configured to connect a power supply of the receiver to the inner conductor, and connect a ground of the receiver to the first outer conductor; and an antenna element connected to a second end of the shielded cable by a second connection portion;

the second connection portion comprising an amplifier and a balance-unbalance converter, the second connection portion configured to connect the antenna element to an input of the amplifier through the balance-unbalance converter, connect an output of the amplifier to the inner conductor, connect the first outer conductor to a ground, and connect the second outer conductor to a ground through the balance-unbalance converter, wherein at least a portion of the shielded cable functions as an antenna for receiving a high-frequency signal.

5. A method of using a shielded cable, the method comprising:

connecting a first end of the shielded cable to a receiver of an electronic device by a first connection portion, such that an inner conductor of the shielded cable is connected to a power supply of the receiver, and a first outer conductor of the shielded cable is connected to a ground of the receiver;

connecting a second end of the shielded cable to an antenna element by a second connection portion, such that the first outer conductor is connected to the antenna element, and the inner conductor is connected to a second outer conductor of the shielded cable; and using at least a portion of the shielded cable as an antenna for receiving a high-frequency signal, wherein the shielded cable comprises the inner conductor, a first insulator, the first outer conductor, a second insulator, and the second outer conductor, which are coaxially disposed in this order from an inner side, and has an outer circumference coated by an insulation sheath.

6. The method of claim 5, wherein connecting the second end of the shielded cable to the antenna element by a second connection portion comprises connecting the antenna element to the first outer conductor through a balance-unbalance converter, and connecting the inner conductor to the second outer conductor through the balance-unbalance converter.

7. The method of claim 6, further comprising:

removing the insulation sheath and the second outer conductor from a portion of the shielded cable; and adjusting a frequency of the antenna.

8. The method of claim 5, further comprising controlling an impedance of the shielded cable by adjusting a length between the first outer conductor and the second outer conductor.

* * * * *